US007985519B2

(12) United States Patent
Kihara et al.

(10) Patent No.: US 7,985,519 B2
(45) Date of Patent: Jul. 26, 2011

(54) AROMATIC POLYCARBONATE, ELECTROPHOTOGRAPHIC PHOTORECEPTOR, AND IMAGE FORMING APPARATUS

(75) Inventors: Akiko Kihara, Nara (JP); Akihiro Kondoh, Nara (JP); Hiroshi Sugimura, Habikino (JP); Takatsugu Obata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 741 days.

(21) Appl. No.: 12/021,506

(22) Filed: Jan. 29, 2008

(65) Prior Publication Data

US 2008/0199215 A1 Aug. 21, 2008

(30) Foreign Application Priority Data

Jan. 29, 2007 (JP) ..... P2007-018587

(51) Int. Cl.
*G03G 5/07* (2006.01)

(52) U.S. Cl. ..... 430/57.1; 430/66

(58) Field of Classification Search ..... 430/57.1, 430/66

See application file for complete search history.

(56) References Cited

U.S. PATENT DOCUMENTS

| | | | | |
|---|---|---|---|---|
| 4,260,671 | A | 4/1981 | Merrill | |
| 4,772,525 | A | 9/1988 | Badesha et al. | |
| 4,801,517 | A | 1/1989 | Frechet et al. | |
| 4,806,444 | A | 2/1989 | Yanus et al. | |
| 4,935,487 | A | 6/1990 | Yanus et al. | |
| 5,278,014 | A | 1/1994 | Tamaki et al. | |
| 5,747,204 | A * | 5/1998 | Anzai et al. | 430/58.3 |
| 6,187,494 | B1 * | 2/2001 | Kawamura et al. | 430/96 |
| 6,265,122 | B1 | 7/2001 | Itami et al. | |
| 2004/0002574 | A1 * | 1/2004 | Ri et al. | 525/203 |
| 2005/0003287 | A1 * | 1/2005 | Kawamura et al. | 430/96 |
| 2006/0204871 | A1 | 9/2006 | Kondoh et al. | |

FOREIGN PATENT DOCUMENTS

JP 50-82056 7/1975

(Continued)

*Primary Examiner* — Hoa V Le
(74) *Attorney, Agent, or Firm* — Nixon & Vanderhye P.C.

(57) ABSTRACT

In an electrophotographic photoreceptor including a conductive substrate and a single layer type photosensitive layer, the aromatic polycarbonate is contained to a single layer type photosensitive layer, which aromatic polycarbonate includes a constituent unit represented by the following general formula (1) derived from a compound having a basic asymmetric bishydroxy enamine skeleton represented by the general formula:

(1)

Accordingly, the electrophotographic photoreceptor is obtained which is excellent in charge transportability, mechanical strength, electric property, durability, etc. and can form good images for a long time.

2 Claims, 3 Drawing Sheets

FOREIGN PATENT DOCUMENTS

| | | | |
|---|---|---|---|
| JP | 63-285552 | A | 11/1988 |
| JP | 64-13061 | A | 1/1989 |
| JP | 64-19049 | A | 1/1989 |
| JP | 3-50555 | A | 3/1991 |
| JP | 3-221522 | A | 9/1991 |
| JP | 4-11627 | A | 1/1992 |
| JP | 4-183719 | A | 6/1992 |
| JP | 5-19497 | A | 1/1993 |
| JP | 5-40350 | A | 2/1993 |
| JP | 5-66598 | A | 3/1993 |
| JP | 6-43674 | A | 2/1994 |
| JP | 10-158380 | A | 6/1998 |
| JP | 20000-242019 | A | 9/2000 |
| JP | 2004-269377 | A | 9/2004 |
| JP | 2004-269813 | A | 9/2004 |
| JP | 2004-334125 | A | 11/2004 |
| JP | 2006-335869 | A | 12/2006 |

* cited by examiner

AROMATIC POLYCARBONATE, ELECTROPHOTOGRAPHIC PHOTORECEPTOR, AND IMAGE FORMING APPARATUS

CROSS-REFERENCE TO RELATED APPLICATION

This application claims priority to Japanese Patent Application No. 2007-18587, which was filed on Jan. 29, 2007, the contents of which are incorporated herein by reference in its entirety.

BACKGROUND OF THE INVENTION

1. Field of the Invention

The present invention relates to an aromatic polycarbonate, an electrophotographic photoreceptor, and an image forming apparatus.

2. Description of the Related Art

Heretofore, in an electrophotographic image forming apparatus such as copying machines, printers, and facsimile machines, polycarbonate resins have been used as a surface layer of an electrophotographic photoreceptor forming electrostatic latent images since they have high mechanical strength and are excellent in wear resistance, and dimensional stability. Particularly, in a function separation type electrophotographic photoreceptor formed by successively laminating, on a conductive substrate, a charge generating layer containing a charge generating substance and a charge transporting layer containing a charge transporting substance, polycarbonates have often been used for the charge transporting layer as an outermost layer as a binder resin for retaining the charge transporting substance in the layer.

As the polycarbonate, aromatic polycarbonates such as bisphenol A polycarbonate obtained by reacting 4,4'-(1-methylethylidene)bisphenol (bisphenol A) and phosgene, and a Z type polycarbonate synthesized from 4,4'-cyclohexylidene bisphenol (bisphenol Z) excellent in wear resistance and solubility have been known as typical examples. Such polycarbonates are generally excellent in the mechanical strength, particularly, mechanical strength at low temperature and also excellent in weather resistance compared with other thermoplastic resins.

By the way, for maintaining electric properties required for the electrographic photoreceptor, the charge transporting layer contains a charge transporting substance in an amount substantially identical with that of the polycarbonate as the binder resin. However, such a ratio of the amount between the polycarbonate and the charge transporting substance causes deterioration of the wear resistance and the durability of the charge transporting layer also along with the fact that the charge transporting substance is low molecular weight compound having a less compatibility with the polycarbonate.

Accordingly, it has been attempted to decrease the addition amount of the charge transporting substance and improve the durability of the charge transporting layer while maintaining the electrical property as the electrophotographic photoreceptor by improving the electric property of the charge transporting substance. A further improvement for the sensitivity and the mobility of the charge transporting substance has been intended by the attempt. However, for the charge transporting substance proposed so far, an addition amount to such an extent as causing an undesired effect on the durability of the charge transporting layer is necessary in order to obtain a desired electric property. Therefore, it is extremely difficult to make the electrical property and the durability compatible.

For solving the problem in the electrophotographic photoreceptor described above, it has been attempted to provide the binder resin with a charge transport capability thereby decreasing the addition amount of the charge transporting substance, and development has been proceeded for a binder resin containing a constituent unit having the charge transport capability, that is, a so-called polymeric photoconductive material. Specific examples thereof include carbazole type polycarbonates having a carbazole ring in the main chain (refer, for example, to Japanese Unexamined Patent Publication JP-A 4-183719 (1992)) and polyvinyl carbazoles having a carbazole ring on the side chain (refer, for example, to Japanese Unexamined Patent Publication JP-A 50-82056 (1975)). The carbazole type polymers involve drawbacks that they are poor in the flexibility and, also have low mechanical strength and, further, they tend to form structural traps as one of the causes for deteriorating the charge transport capability.

Further, there are polystyrene compounds having hydrazone side chains (refer, for example, to Japanese Unexamined Patent Publication JP-A 3-50555 (1991)), aryl amine compounds having a tertiary amine structure in the main chain (refer, for example, to Japanese Unexamined Patent Publications JP-A 1-13061 (1989), JP-A 1-19049 (1989) and JP-A 5-40350 (1993)), and (meth)acrylic acid copolymers having a tertiary amine structure (triphenylamine skeleton) on the side chains (refer, for example, to Japanese Unexamined Patent Publication JP-A 5-66598 (1993)). Also the polymers are not sufficiently satisfactory in view of the charge transport capability and the mechanical strength.

Further, although all of the polymers described in JP-A 4-183719, JP-A 50-82056, JP-A 3-50555, JP-A 1-13061, JP-A 1-19049, JP-A 5-40350, and JP-A 5-66598 is a π-electron conjugation system, there are polysilanes having a conduction mechanism by way of a σ-electron conjugation system different therefrom (refer, for example, to Japanese Unexamined Patent Publications JP-A 63-285552 (1988) and JP-A 5-19497 (1993)). While polysilanes are excellent in the charge transport capability, since they are easily decomposed by an ultraviolet light and also poor in the mechanical strength, they have not yet been to practical use.

Further, there are polycarbonate type copolymers prepared by using a monomer for the charge transporting substance and copolymerizing the monomer with a polycarbonate monomer with an aim of improving the mechanical strength (refer, for example, to Japanese Unexamined Patent Publications JP-A 3-221522 (1991) and JP-A 4-11627 (1992)). However, such copolymers are not at a sufficiently satisfactory level both in the charge transport capability and the mechanical strength.

Further, there is an aromatic polycarbonate prepared by using a monomer as an enamine compound excellent in the charge transport capability (refer, for example, to Japanese Unexamined Patent Publication JP-A 6-43674 (1994) and the specification of Japanese Examined Patent Publication JP-B2 3580426) and copolymerizing the enamine monomer with a polycarbonate monomer (refer, for example, to Japanese Patent Unexamined Patent Publication JP-A 2004-269813). However, since the aromatic polycarbonate has a high structural symmetry tending to cause crystallization, this results in a disadvantage that crystallized portions form image defects when it is used as a resin for a photosensitive layer of an electrophotographic photoreceptor.

Further, it has also been conducted to laminate a surface protection layer on a photosensitive layer in order to improve the mechanical strength of the photosensitive layer such as a charge transporting layer. The surface protection layer usually contains a conductive material and a binder resin. Then, for the binder resin it has been proposed, for example, polycarbonates having polar groups (refer, for example, to U.S. Pat. No. 4,260,671 A) and polycarbonates having fluoro substituted alkyl groups (refer, for example, to Japanese Unexamined Patent Publication JP-A 10-158380 (1998)). However, in such electrophotographic photoreceptor, since a potential barrier is formed at the boundary between the surface protection layer and the charge transporting layer due to the disconformity between the charge transporting substance in the charge transporting layer and the conductive material in the surface protection layer, injection of charges is insufficient to lower the sensitivity and at least one of peeling or cracking occurs during manufacture due to the difference of the shrinkage caused by the difference of materials in both of the layers failing to attain a sufficient performance.

Further, a surface protection layer comprising a siloxane type resin has been proposed recently (refer, for example, to Japanese Unexamined Patent Publication JP-A 2000-242019). However, heat curing of the siloxane type resin is necessary for forming the surface protection layer by using the siloxane resin, but the material in the photosensitive layer may sometimes be degraded by heating. Further, since the siloxane resin per se is an insulator, it is necessary to add a low molecular compound having the charge transport capability but addition of such a low molecular compound also causes lowering of the mechanical strength of the surface protection layer like in the charge transporting layer.

SUMMARY OF THE INVENTION

An object of the invention is to provide a novel aromatic polycarbonate which is excellent in the mechanical strength, has extremely good electrical property, high charge potential and sensitivity, suffers from extremely less change for various properties even upon repetitive application of voltage, irradiation of a laser light, deposition of a toner and heating and pressurization, and can form high quality images stably for a long time when the aromatic polycarbonate is used as a matrix for forming a photosensitive layer in an electrophotographic photoreceptor, to provide an electrophotographic photoreceptor utilizing the aromatic polycarbonate, and to provide an image forming apparatus.

As a result of an earnest study for solving the problems, the present inventors have succeeded in obtaining an aromatic polycarbonate resin containing an asymmetric bishydroxy compound as a constituent unit and attaining the purpose of the invention, and have accomplished the invention.

The invention provides an aromatic polycarbonate comprising a constituent unit represented by the following general formula (1) (hereinafter often referred to as "constituent unit (1)"):

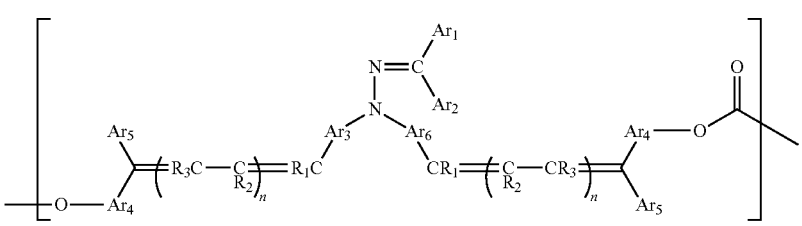

(1)

(where $Ar_1$ and $Ar_2$ are identical with or different from each other and each represent an aryl group which may have a substituent or a heterocyclic group which may have a substituent, $Ar_3$ represents an arylene group which may have a substituent or a bivalent heterocyclic group which may have a substituent, two $Ar_4$ are identical with or different from each other and each represent an arylene group which may have a substituent or a bivalent heterocyclic group which may have a substituent, two $Ar_5$ are identical with or different from each other and each represent a hydrogen atom, an aryl group which may have a substituent, a heterocyclic group which may have a substituent, an aralkyl group which may have a substituent, or an alkyl group which may have a substituent, $Ar_6$ represents an arylene group which may have a substituent or a bivalent heterocyclic group which may have a substituent, providing that $Ar_3$ and $Ar_6$ should not be identical, $R_1$ represents a hydrogen atom or an alkyl group which may have a substituent, $R_2$ and $R_3$ by the number of 2n are identical with or different from each other and each represent a hydrogen atom, an alkyl group which may have a substituent, an aryl group which may have a substituent, a heterocyclic group which may have a substituent, or an aralkyl group which may have a substituent, and n represents an integer of 0 to 2).

According to the invention, an aromatic polycarbonate which is a polymer containing the constituent unit (1) is obtained. The aromatic polycarbonate not only has a good charge transport capability but also is excellent in the mechanical strength, the electrical property, and the durability and can be used suitably as a matrix resin, for example, for a photosensitive layer in a single layer type electrophotographic photoreceptor, a charge transporting layer in a layered type electrophotographic photoreceptor, and a surface protection layer in the single layer type and the layered type electrophotographic photoreceptor. Further, in a case of using the aromatic polycarbonate according to the invention as a charge transporting substance and using another aromatic polycarbonate as a matrix resin, for example, in the photosensitive layer and the charge transporting layer, since the compatibility with the matrix resin is favorable, a uniform charge transport capability is provided in the photosensitive layer and the charge transporting layer.

Further, the aromatic polycarbonate according to the invention can be used not only as the charge transporting substance in the electrophotographic photoreceptor, the matrix resin for use in the charge transporting layer and the single layer type photosensitive layer but also suitably used as sensor materials, organic electroluminescence (EL) devices, and organic photorefractive devices.

Further, in the invention, it is preferable that in addition to the constituent unit (1) the aromatic polycarbonate further comprises a constituent unit represented by the following general formula (2) (hereinafter often refer to as "constituent unit (2)"):

(2)

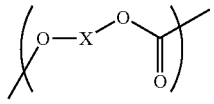

(where X represents a substituted or non-substituted linear aliphatic bivalent group, a substituted or non-substituted cyclic aliphatic bivalent group, a substituted or non-substituted aromatic bivalent group, a substituted or non-substituted heterocyclic bivalent group, or a bivalent group formed by bonding them, or a bivalent group formed by bonding the same with one selected from the group consisting of an oxygen atom and a sulfur atom).

According to the invention, an aromatic polycarbonate as a copolymer comprising the constituent unit (2) together with the constituent unit (1) is obtained. The aromatic polycarbonate is excellent in charge transport capability, mechanical strength, electrical property and durability and can be used suitably as a matrix resin, for example, for a photosensitive layer in a single layer type electrophotographic photoreceptor, a charge transporting layer in a layered type electrophotographic photoreceptor, and a surface protection layer in a single layer type or layered type electrophotographic photoreceptor.

Further, in the invention, it is preferable that the constituent unit (1) is a constituent unit represented by the following general formula (3) (hereinafter often referred to as "constituent unit (3)"):

(3)

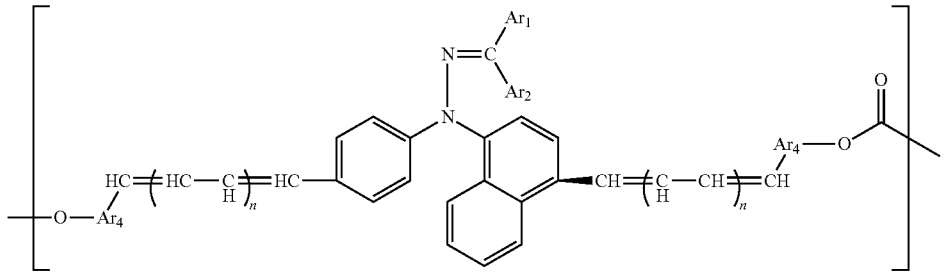

(where $Ar_1$ and $Ar_2$ are identical with or different from each other and each represent an aryl group which may have a substituent or a heterocyclic group which may have a substituent, two $Ar_4$ each represent an arylene group which may have a substituent or a bivalent heterocyclic group which may have a substituent, and n represents an integer of 0 to 2).

Further, in the invention, it is preferable that the constituent unit (3) is a constituent unit represented by the following general formula (4) (hereinafter often refer to as "constituent unit (4)"):

(4)

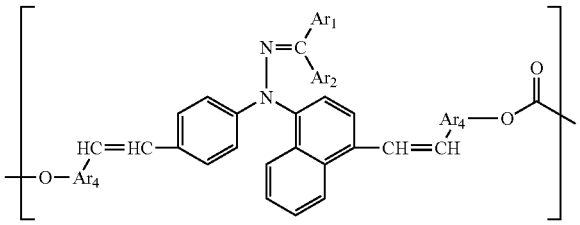

(where $Ar_1$ and $Ar_2$ are identical with or different from each other and each represent an aryl group which may have a substituent or a heterocyclic group which may have a substituent, two $Ar_4$ represent an arylene group which may have a substituent or a bivalent heterocyclic group which may have a substituent).

According to the invention, when considering stability of the less causing decomposition or denaturation as a chemical substance, easy availability, and production cost, the constituent unit (3) is preferred and the constituent unit (4) is more preferred in the constituent unit (1).

Further, in the invention, it is preferable that in the constituent unit (2), X is a bivalent group represented by the general formula (5):

(5)

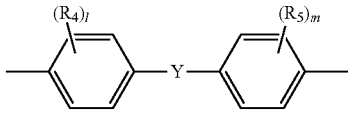

(where $R_4$ by the number of l and $R_5$ by the number of m are identical with or different from each other and each represent a hydrogen atom, a lower alkyl group of 1 to 4 carbon atoms, a lower alkoxy group of 1 to 4 carbon atoms, or a halogen atom, Y represents a single bond, an oxygen atom, a sulfur atom, a substituted or non-substituted linear aliphatic bivalent group, a substituted or non-substituted cyclic aliphatic bivalent group, or bivalent group formed by bonding two or more of them, and l and m are identical with or different from each other and each represent an integer of 1 to 4).

According to the invention, by using the constituent unit (2) in which the bivalent group represented by X is a bivalent group of the general formula (5), the mechanical strength, the durability, the weather resistance, the chemical resistance, etc. of the obtained aromatic polycarbonate are further improved.

Further, the invention provides an electrophotographic photoreceptor comprising a conductive substrate and a photosensitive layer containing the aromatic polycarbonate mentioned above on the conductive substrate.

According to the invention, an electrophotographic photoreceptor is provided that comprises a conductive substrate and a photosensitive layer containing the aromatic polycarbonate mentioned above on the conductive substrate. The electrophotographic photoreceptor concurrently has various performances such as the charge transport capability, the mechanical strength, the electrical property, the durability (also including wear resistance) at extremely high level. Accordingly, when the electrophotographic photoreceptor is used, the amount of the reduction of layer thickness is extremely small, the electrical property scarcely changes from that in the initial state even when image formation of 100,000 copies or more is conducted, and it is possible to stably form high quality images with no image defects such as fogging, black spots or white spots.

Further, the invention provides an electrophotographic photoreceptor comprising a conductive substrate, a photosensitive layer formed on the conductive substrate, and a surface protection layer containing the aromatic polycarbonate mentioned above formed on the photosensitive layer.

According to the invention, an electrophotographic photoreceptor is provided that comprises a photosensitive layer and a surface protection layer containing the aromatic polycarbonate. The electrophotographic photoreceptor has various performances such as charge transportability, mechanical strength, electric property, and durability (also including wear resistance) at extremely high levels together. Accordingly, by using the electrophotographic photoreceptor, even when image formation of 100,000 copies or more is conducted, the amount of the reduction of layer thickness is extremely small, the electrical property scarcely changes from that in the initial state, and high quality images with no image defects such as fogging, black spots and white spots can be formed stably.

Further, the invention provides an image forming apparatus comprising the electrophotographic photoreceptor mentioned above, a charging section for charging the electrophotographic photoreceptor, an exposure section for exposing the electrophotographic photoreceptor in a charged state by a light in accordance with image information to form electrostatic latent images, a developing section for developing the electrostatic latent images formed on the electrophotographic photoreceptor thereby visualizing them, and a transfer section for transferring visual images developed by the developing section onto a recording medium.

According to the invention, an image forming apparatus is provided, which includes the electrophotographic photoreceptor, a charging section for charging the electrophotographic photoreceptor, an exposure section for exposing the electrophotographic photoreceptor in a charged state by a light in accordance with image information to form electrostatic latent images, a developing section for developing the electrostatic latent images formed on the electrophotographic photoreceptor thereby visualizing them, and a transfer section for transferring visual images developed by the developing section onto a recording medium. The image forming apparatus can stably form high quality images with no image defects such as fogging, black spots and white spots.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
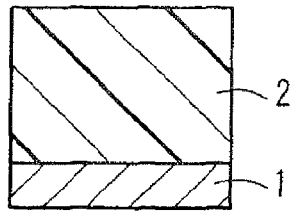
FIG. 1 is a cross sectional view schematically showing the constitution for a main portion of a single layer type electrophotographic photoreceptor of the invention.

Now referring to the drawings, preferred embodiments of the invention are described below.

[Aromatic Polycarbonate]

An aromatic polycarbonate of the invention is a polymer containing the constituent unit (1). The aromatic polycarbonate may be a homopolymer containing the constituent unit (1), a copolymer containing the constituent unit (1), or a copolymer containing the constituent unit (1) and the constituent unit (2). Among the homopolymer and the copolymers, those containing the constituent unit (3) as the constituent unit (1) are preferred and those containing the constituent unit (4) are particularly preferred with a view point that the availability or the synthesis of the starting materials is easy and, thus, the material cost is low and with a view point of the stability as the compound. Further, among the constituent units represented by the general formula (2), those containing the constituent unit represented by the following general formula (5) are preferred.

In a case where the aromatic polycarbonate of the invention is a copolymer containing the constituent unit (1) and the constituent unit (2), while the containment ratio for the constituent unit (1) and the constituent unit (2) is not particularly restricted, it is usually as: constituent unit (1): constituent unit (2)=5 to 95:95 to 5 (molar ratio), preferably, 20 to 60:40 to 80 (molar ratio) and, more preferably, 30 to 45:70 to 55 (molar ratio). In a case where the constituent unit (1): constituent unit (2) is within a range of 5 to 95:95 to (molar ratio), an effect of making the mechanical strength and the electrical property compatible can be developed further.

The ratio of the aromatic polycarbonate of the invention occupying in the homopolymer and the copolymer is preferably 50% by weight or more and, more preferably, 80% by weight or more.

The number average molecular weight (Mn) of the aromatic polycarbonate of the invention is, usually, from 5,000 to 500,000, preferably, from 10,000 to 100,000 and, more preferably, from 15,000 to 60,000. In a case where Mn is less than 5,000, this is not preferred since the layer strength is weakened. In a case where Mn exceeds 500,000, this is not preferred, since the solubility to the solvent during manufacture becomes poor.

Further, the weight average molecular weight (Mw) of the aromatic polycarbonate of the invention is, usually, from 5,000 to 500,000, preferably, from 10,000 to 300,000 and, more preferably, from 20,000 to 150,000. In a case where Mw is less than 5,000, this is not preferred since the layer strength is weakened. In a case where Mw exceeds 500,000, this is not preferred, since the solubility to the solvent during manufacture becomes poor.

The number average molecular weight (Mn) is a number average molecular weight calculated based on polystyrene measured by gel permeation chromatography (GPC) and the weight average molecular weight (Mw) is a weight average molecular weight calculated based on polystyrene measured by gel permeation chromatography (GPC).

In the general formula (1), the general formula (3), and the general formula (4), the aryl group represented by symbol $Ar_1$ and symbol $Ar_2$ which may have a substituent includes aryl groups which may have a substituent selected from alkyl groups of 1 to 4 carbon atoms and alkoxy groups of 1 to 4 carbon atoms such as phenyl, tolyl, methoxyphenyl, naphthyl, and biphenylyl. Among them, phenyl, tolyl, methoxyphenyl, and naphthyl are preferred.

Further, the heterocyclic group which may have a substituent includes heterocyclic groups which may have alkyl groups of 1 to 4 carbon atoms as the substituent such as furyl, thienyl, thiazolyl, benzofuryl, and N-methylindolyl.

The arylene group represented by symbol $Ar_3$ and symbol $Ar_6$ in the general formula (1) and represented by symbol $Ar_4$ in the general formula (1), general formula (3) and the general formula (4) which may have a substituent includes arylene groups which may have substituents selected from alkyl group of 1 to 4 carbon atoms, alkoxy group of 1 to 4 carbon atoms, phenoxy group, and phenylthio group such as p-phenylene, m-phenylene, methyl-p-phenylene, methoxy-p-phenylene, 1,4-naphthylene, pyrenylene, biphenylene, phenoxyphenylene, and phenylthiophenylene. Among them, p-phenylene, m-phenylene, methyl-p-phenylene, methoxy-p-phenylene, and 1,4-naphthylene are preferred, and p-phenylene and 1,4-naphthylene are particularly preferred.

Further, examples of the bivalent heterocyclic group which may have a substituent include 1,4-furandiyl, 1,4-thiophenediyl, 1,4-thiazolediyl, 2,5-benzofurandiyl, 2,5-benzothiophenediyl, N-methylindole-2,5-diyl, 2,5-benzothiazolediyl, 2,5-benzooxazolediyl, and N-ethylcarbazole-3,6-diyl.

It is particularly preferred for a case where one of $Ar_3$ and $Ar_6$ is p-phenylene and the other is 1,4-naphthylene, that is, a case of containing the constituent unit (3) since the starting material is available at a low cost or synthesized easily, and an aromatic polycarbonate containing the constituent unit (4) where n is 0 is further preferred.

In the general formula (1), the aryl group represented by $Ar_5$ which may have a substituent includes aryl groups which may have a substituent selected from alkoxy groups of 1 to 4 carbon atoms, phenoxy group, phenylthio group, and stylyl group such as phenyl, tolyl, methoxyphenyl, naphthyl, pyrenyl, biphenylyl, phenoxyphenyl, p-(phenylthio)phenyl, and p-stylylphenyl. Among them, phenyl, methoxyphenyl, and naphthyl are preferred. The heterocyclic ring which may have a substituent includes heterocyclic groups which may have an alkyl group of 1 to 4 carbon atoms as the substituent such as furyl, thienyl, thiazolyl, benzofuryl, benzothiophenyl, N-methylindolyl benzothiazolyl, benzooxazolyl, and N-ethylcarbazolyl. The aralkyl group which may have a substituent includes aralkyl groups which may have an alkoxy group of 1 to 4 carbon atoms as the substituent such as benzyl, p-methoxybenzyl, and 1-naphtylmethyl. The alkyl group which may have a substituent include linear or branched alkyl groups of 1 to 4 carbon atoms which may have a substituent selected from a halogen atom and 2-thienyl group, such as methyl, 2-thienylmethyl, ethyl, trifluoromethyl, fluoromethyl, isopropyl, and tert-butyl, and cycloalkyl groups such as cyclohexyl and cyclopentyl.

In the general formula (1), the alkyl group which may have a substituent represented by symbol $R_1$, symbol $R_2$ and symbol $R_3$ includes linear or branched alkyl groups of 1 to 4 carbon atoms which may have a substituent selected from a halogen atoms and a 2-thienyl group, such as methyl, ethyl, n-propyl, isopropyl, trifluoromethyl, and 2-thienylmethyl. The aryl group which may have a substituent includes aryl groups which may have a substituent selected from alkyl groups of 1 to 4 carbon atoms and alkoxy groups of 1 to 4 carbon atoms such as phenyl, tolyl, methoxyphenyl, and naphthyl. Among them, phenyl and naphthyl are preferred. The heterocyclic group which may have a substituent includes furyl, thienyl, and thiazolyl. The aralkyl group which may have a substituent includes aralkyl groups which may have an alkoxy group of 1 to 4 carbon atoms such as benzyl and p-methoxybenzyl.

The group represented by symbol X in the general formula (2) is a substituted or non-substituted linear aliphatic bivalent group, a substituted or non-substituted cyclic aliphatic bivalent group, a substituted or none substituted aromatic bivalent group, substituted or non-substituted heterocyclic bivalent group, or a bivalent group formed by bonding them, or a bivalent group formed by bonding them with one selected from the group including an oxygen atom and a sulfur atom.

Among them, as the structural unit represented by the general formula (2), the bivalent group represented by the general formula (5) is preferred. The aromatic polycarbonate which is a copolymer containing the constituent unit (1) together with the constituent (2) is excellent in the charge transport capability, the mechanical strength, the electric property, and the durability and can be used suitably as a matrix resin for a photosensitive layer in a single layer type electrophotographic photoreceptor, charge transporting layer in a layered type electrophotographic photoreceptor, and a surface protection layer in a single layer type and a layered type electrophotographic photoreceptor.

Further, in the general formula (5), $R_4$ by the number of l and $R_5$ by the number of m are identical with or different from each other and each represent a hydrogen atom, a lower alkyl of 1 to 4 carbon atoms, a lower alkoxy group of 1 to 4 carbon atoms, or a halogen atom. Y represents a single bond, an oxygen atom, a sulfur atom, a substituted or non-substituted linear aliphatic bivalent group, a substituted or non-substituted cyclic aliphatic bivalent group, or a bivalent group formed by bonding two or more of them. l and m are identical with or different from each other and each represent an integer of 1 to 4. For example, the symbol $R_4$, $R_5$, include each a hydrogen atom and a 3-methyl group and symbol Y includes a dimethylmethane group, or a cyclohexylidene group. Among them, the structural unit represented by the general formula (5) is preferably a bisphenol Z skeleton. By using the constituent unit (2) in which the bivalent group represented by X is the bivalent group in the general formula (5), the mechanical strength, the durability, the weather resistance, the chemical resistance, etc. of the obtained aromatic polycarbonate are further improved.

[Preparation Method of Aromatic Polycarbonate]

Among the aromatic polycarbonates of the invention, the homopolymer comprising the constituent unit (1) can be produced, for example, in the same manner as the existent polycarbonate except for using, as the starting compound (monomer), one or more of asymmetric bishydroxyl compounds having the charge transport capability and one or more of carbonate compounds.

Further, among the aromatic polycarbonates of the invention, the copolymer containing the constituent unit (1) and the constituent unit (2) can be produced, for example, in the same manner as the existent polycarbonate except for using, as the starting material compound (monomer), one or more of asymmetric bishydroxyl compounds having the charge transport capability, one or more of the carbonate compounds, and one or more of the dihydroxy compounds.

[Asymmetric Bishydroxy Compound]

As the asymmetric bishydroxy compound having the charge transport capability, known compounds can be used, and examples thereof include asymmetric bishydroxy compounds represented by the following general formula (6) (hereinafter often referred to as "asymmetric bishydroxy compound (6)").

Among the asymmetric bishydroxy compounds (6), an asymmetric bishydroxy compound represented by the following general formula (7) (hereinafter often referred to as "asymmetric bishydroxy compound (7)") is preferred, and an asymmetric bishydroxy compound represented by the following general formula (8) (hereinafter often referred to as "asymmetric bishydroxy compound (8)") is particularly preferred:

(6)

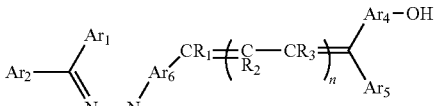

(7)

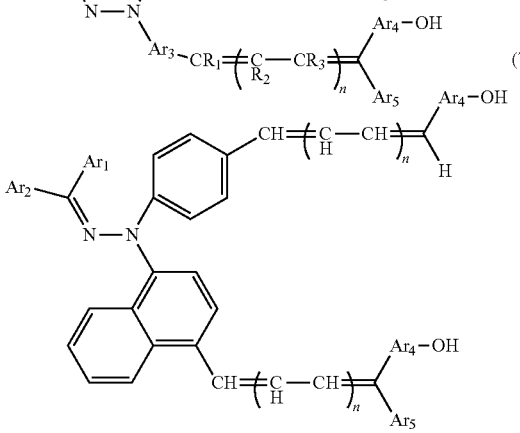

-continued (8)

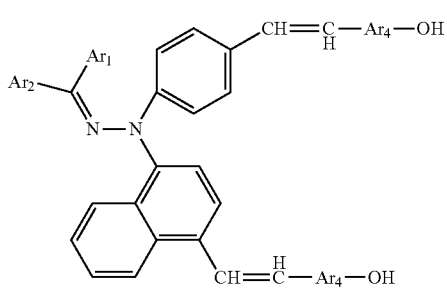

(where $Ar_1$, $Ar_2$, $Ar_3$, $Ar_4$, $Ar_5$, $Ar_6$, $R_1$, $R_2$, $R_3$ and n have the same meanings as described above.

The asymmetric bishydroxy compound (6) can be produced, for example, by preparing an asymmetric bishydroxy ether compound represented by the following general formula (12a) (hereinafter often referred to as "ether compound (12a)"), or an asymmetric bishydroxy ether compound represented by the following general formula (12b) (hereinafter often referred to as "ether compound (12b)") by a method shown by the following reaction scheme, and further deprotecting the protection group for the hydroxy group shown by symbol $R_7$.

[Reaction Scheme]

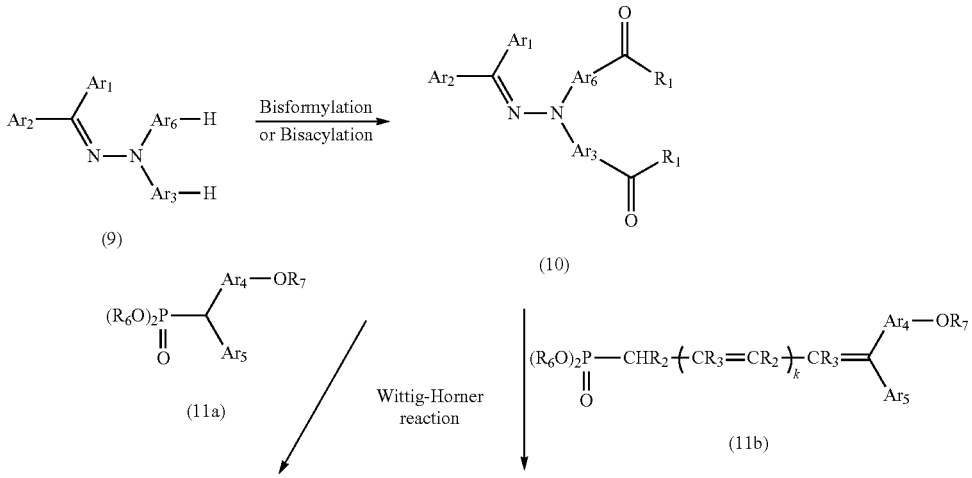

-continued

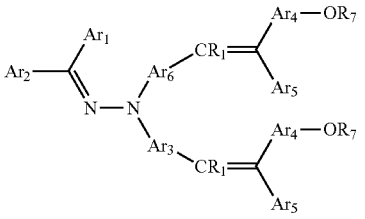

(12a)

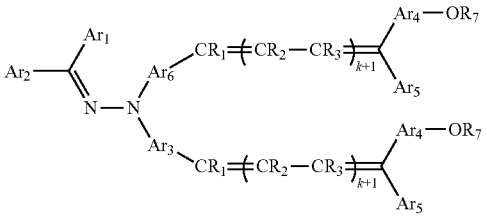

(12b)

Deprotection reaction

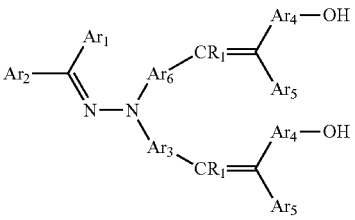

(6A)

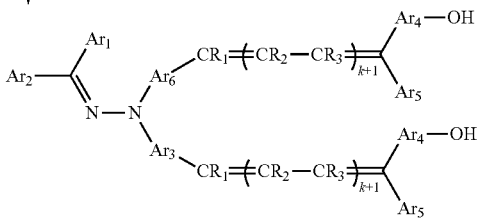

(6b)

(where $Ar_1$, $Ar_2$, $Ar_3$, $Ar_4$, $Ar_5$, $Ar_6$, $R_1$, $R_2$, and $R_3$ have the same meanings as described above. Two $R_6$ are identical with or different from each other and each represent a hydrogen atom, alkyl group which may have a substituent, aryl group which may have a substituent, a heterocylic group which may have a substituent, or an aralkyl group which may have a substituent, two $R_7$ are identical with or different from each other and each represent a hydrogen atom, alkyl group which may have a substituent, aryl group which may have a substituent, a heterocyclic group which may have a substituent, or aralkyl group which may have a substituent, and k represents an integer of 0 to 1).

In the reaction scheme, the alkyl group shown by symbol $R_3$ or symbol $R_7$ which may have a substituent includes linear or branched alkyl groups of 1 to 4 carbon atoms which may have a substituent selected from a halogen atom and 2-thienyl group, such as methyl, ethyl, n-propyl isopropyl, trifluoromethyl and 2-thienylmethyl. The aryl group which may have a substituent includes aryl groups which may have a substituent selected from alkyl groups of 1 to 4 carbon atoms and alkoxy groups of 1 to 4 carbon atoms such as phenyl, tolyl, methoxyphenyl, and naphthyl. Among them, phenyl and naphthyl, etc. are preferred.

The heterocyclic group represented by symbol $R_3$ or Symbol $R_7$ includes furyl, thienyl, thiazolyl, etc. The aralkyl group which may have a substituent includes an aralkyl group having an alkyl moiety comprising a linear or branched alkylene group of 1 to 3 carbon atoms and having an alkoxy group of 1 to 4 carbon atoms such as benzyl or p-methoxybenzyl.

Each of the reactions in the reaction scheme can be conducted, for example, as described below.

A hydrazone-bisaldehyde compound represented by the general formula (10) (hereinafter often referred to as "hydrazone-bisaldehyde compound (10)") can be synthesized by bisformylating a hydrazone compound represented by the general formula (9) (hereinafter often referred to as "hydrazone compound (9)").

The hydrazone compound (9) can be produced, for example, by dehydrating condensation reaction of a ketone compound represented by the following general formula (13a) (hereinafter often referred to as "ketone compound (13a)" and a hydrazine compound represented by the following general formula (13b) (hereinafter often referred to as "hydrazine compound (13b)"):

(13a)

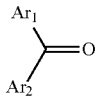

(13b)

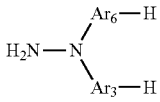

(where $Ar_1$, $Ar_2$, $Ar_3$ and $Ar_6$ have the same meanings as described above).

The dehydrating condensation reaction proceeds substantially quantitatively by heating the ketone compound (13a) and the hydrazine compound (13b) in an alcoholic solvent under the presence of an acid catalyst. While the reaction temperature and the reaction time for the dehydrating condensation reaction are not particularly restricted and optionally selected properly in accordance with various conditions such as the kind and the amount of the ketone compound and the hydrazine compound to be used, they are preferably within a range of reaction temperature from 70 to 80° C. for 4 to 8 hours. Examples of the alcoholic solvent used for the dehydrating condensation reaction include ethanol, isopropanol, and butanol. Further, examples of the acid catalyst include p-toluene sulfonic acid, camphor sulfonic acid, and acetic acid. While the addition amount of the acid catalyst is not restricted, it is preferably from 0.001 to 0.01 molar equivalent, more preferably from 0.002 to 0.04 molar equivalent and, further preferably, from 0.005 to 0.02 molar equivalent based on 1.0 molar equivalent of the ketone compound (13a). The hydrazine compound (9) is obtained by the reaction. For example, a hydrazine compound (9) in which one of $Ar_3$ and $Ar_6$ is a phenylene group and the other of them is a naphthylene group, and $Ar_1$ and $Ar_2$ are each a phenyl group can be produced by using a benzophenone as the ketone compound (13a) and 1-naphthyl-1-phenylhydrazone as the hydrazine compound (13b).

Bisformylation of the hydrazone compound (9) can be conducted, for example, by a known bisformylation reaction such as Vilsmeier bisformylation reaction. The Vilsmeier bisformylation reaction for the hydrazone compound (9) is conducted, for example, as described below.

At first, phosphorous oxychloride and N,N-dimethylformamide (DMF), N,N-diethylformamide, N,N-dibutylformamide, N-methyl-N-phenylformamide, or N,N-diphenylformamide are added in an appropriate solvent to prepare a Vilsmeier reagent.

Examples of the solvent usable for the reaction include polar aprotic solvents such as N,N-dimethylformamide, halogenated hydrocarbons such as 1,2-dichloroethane, and aromatic hydrocarbons such as toluene. For example, N,N-dimethylformamide described above may be used also as the solvent.

Then, 1.0 molar equivalent of the hydrazone compound (9) is added to 2.0 to 2.3 molar equivalent of the produced Vilsmeier reagent and reacted while stirring under heating at 80 to 120° C. for 2 to 10 hours. After the completion of the reaction, hydrolysis is conducted with an aqueous alkali solution to obtain a hydrazone-bisaldehyde compound (10) as a solid at a high yield. The aqueous alkali solution used for hydrolysis includes, for example, an aqueous 1 to 8N solution of sodium hydroxide or potassium hydroxide.

The biscarbonyl compound (10) described in the reaction scheme above can be obtained by using, for example, anhydrous acetic acid or acetyl chloride and subjecting the same to a known bisacylating reaction and to the same treatment as the reaction instead of the bisformylation reaction.

Further, by subjecting the biscarbonyl compound (10) to Wittig-Horner reaction to react the biscarbonyl compound (10) and a Wittig reagent, thereby obtaining the ether compound (12a) or the ether compound (12b) as a precursor of the asymmetric bishydroxy compound (6). The Wittig reagent includes a Wittig reagent represented by the general formula (11a) (hereinafter often referred to as "Wittig reagent (11a)"), or a Wittig reagent represented by the general formula 11b) (hereinafter often referred to as "Wittig reagent (11b)"). The Wittig reagents (11a) and (11b) are protected at the hydroxy group that further substitutes the substituent represented by the symbol $Ar_4$ by a substituent represented by symbol $R_7$.

The ether compound (12a) is obtained by reacting the biscarbonyl compound (10) and the Wittig reagent (11a) and, further, by deprotecting the protection group $R_7$, and an asymmetric bishydroxy compound in which n=0 in the asymmetric hydroxyl compound (6) (hereinafter often referred to as "asymmetric bishydroxy compound (6a)") is obtained. Further, by reacting the biscarbonyl compound (10) and the Wittig reagent (11b), the ether compound (12b) is obtained. Further, by deprotecting the protection group $R_7$, an asymmetric bishydroxy compound in which n−1 or 2 in the asymmetric hydroxy compound (6) (hereinafter often referred to as "asymmetric bishydroxy compound (6b") is obtained.

The Wittig Horner reaction to the biscarbonyl compound (10) can be conducted in accordance with a known method. For example, an aimed substance can be obtained by reacting the biscarbonyl compound (10) and the Wittig reagent (11a) or (11b) in an appropriate solvent under the presence of a base catalyst such as a metal alkoxide.

As the solvent, any solvent inert to the reaction and capable of dissolving or dispersing the reaction substrate and the catalyst can be used with no particular restriction and examples thereof include aromatic hydrocarbons such as toluene and xylene; ethers such as diethylethers, tetrahydrofurane, and ethylene glycol dimethyl ether; amides such as N,N-dimethylforamide; and sulfoxides such as dimethylsulfoxide. They may be used each alone or as a mixed solvent. Further, the amount of use of the solvent is not particularly restricted and can be selected properly as such an amount to smoothly proceeding the reaction in accordance with the reaction conditions such as the amount of the reaction substrate to be used, the reaction temperature, the reaction time, and the like.

As the metal alkoxide basic catalyst, known metal alkoxide basic catalysts can be used and, for example, alkali metal alkoxides such as potassium-t-butoxide, sodium ethoxide and sodium methoxide can be used. The metal alkoxides described above can be used each alone or two or more of them in combination.

The amount for use of the reaction substrate and the catalyst is not particularly restricted and can be selected properly in accordance with the reaction conditions. In view of the smooth proceeding of the reaction, etc. it is preferred to use the Wittig reagent (11a) or the Wittig reagent (11b) by about 2.0 to 2.3 equivalent and the catalyst by about 2.0 to 2.5 molar equivalent based on 1 molar equivalent of the biscarbonyl compound (10).

In the reaction, reactants are stirred, for example, at a room temperature or under heating at 30 to 60° C., for about 2 to 8 hours and treated in accordance with a customary method to obtain the ether compound (12a) or the ether compound (12b).

For obtaining the asymmetric bishydroxy compound (6a) or the asymmetric bishydroxy compound (6b), deprotection of the ether compound (12a) or the ether compound (12b) can be conducted in accordance with the known method. For example, it can be conducted by reacting the ether compound (12a) or the ether compound (12b) and a deprotecting agent in an appropriate solvent. For the deprotecting agent, known deprotecting agents can be used and examples thereof include hydrogen halides such as hydrogen bromide and hydrogen iodide; aluminum halides such as aluminum chloride and aluminum bromide; boron tribromide; and ethanethiol sodium salt. For the deprotecting agent, the compound described can be used each alone or in combination of two or more of them. While the amount of use for the deprotecting agent is not particularly restricted, it is used preferably by from 2.0 to 3.0 molar equivalent and, more preferably, by from 2.0 to 2.6 molar equivalent based on 1 molar equivalent of the ether compound (12a) or the ether compound (12b) considering smooth proceeding of the reaction or easy isolation and purification of the aimed compound after the completion of the reaction. As the solvent for the deprotecting reaction, any solvent inert to the reaction and capable of stably dissolving or dispersing the reaction substrate can be used with no particular restriction. For example, aromatic hydrocarbons such as benzene, nitrobenzene, halogenated aromatic compounds such as chlorobenzene, formamides such as N,N-dimethylformamide, anhydrous acetic acid, and methylene chloride can be used suitably. The solvent can be property selected and used in accordance with the type of the deprotecting agent. For example, as the reaction solvent, anhydrous acetic acid is preferred in a case of using hydrogen halide, and aromatic hydrocarbons or halogenated aromatic hydrocarbons are preferred in a case of using the aluminum halide as the deprotecting agent. Further, as the reaction solvent, methylene chloride is preferred in a case of using boron tribromide and formamides are preferred in a case of using ethanethiol sodium salts as the deprotecting agent. The amount of use for the solvent is not particularly restricted and can be properly selected in accordance with reaction conditions such as the kind and the amount of use for the reaction substrate and the deprotecting agent, and reaction temperature. The deprotecting reaction is conducted under various reaction conditions, for example, under cooling or at a room temperature to the temperature of causing solvent reflux in accordance with the activity of the deprotecting agent, and completed in about 0.5 to 24 hours. As the reaction temperature, a temperature capable of smoothly proceeding the deprotecting reaction may be properly selected.

The thus obtained asymmetric bishydroxy compound (6) according to the invention can be easily isolated and purified from a reaction mixture after the completion of the reaction by a usual purification apparatus such as extraction, chromatography, centrifugal separation, recrystallization, or cleaning.

Specific examples of the asymmetric bishydroxy compound (6) include those described in the following Table 1 to Table 7.

TABLE 1

| Exemplified compound No. | $Ar^1$ | $Ar^2$ | n | $CR^2{=}CR^3$ | $R^1$ |
|---|---|---|---|---|---|
| 1 | 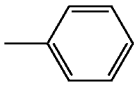 | 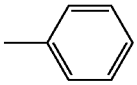 | 0 | CH═CH | H |
| 2 | 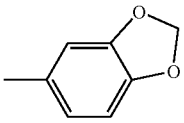 | $—C_2H_5$ | 1 | CH═CH | H |
| 3 | 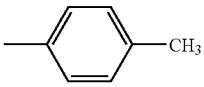 | H | 1 | CH═CH | $—CH_3$ |
| 4 | 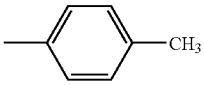 | H | 1 | CH═CH | H |
| 5 | 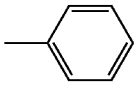 | 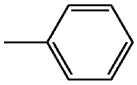 | 1 | CH═CH | $—CH_3$ |
| 6 | 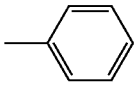 | 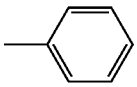 | 1 | CH═CH | H |
| 7 | 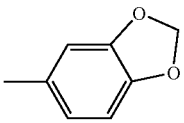 | 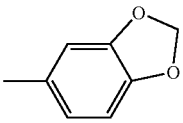 | 1 | CH═CH | H |
| 8 | 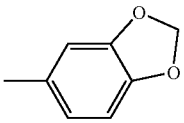 | $—CH_3$ | 1 | CH═CH | H |
| 9 | 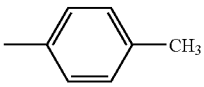 | 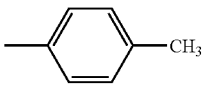 | 1 | CH═CH | H |

TABLE 1-continued
| Exemplified compound No. | N—Ar$^6$— | Ar$^4$ | Ar$^5$ | |
|---|---|---|---|---|
| 1 | 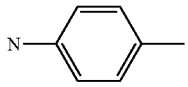 | 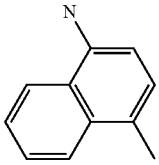 | 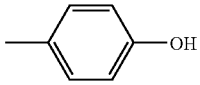 | H |
| 2 | 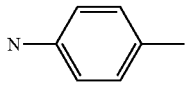 | 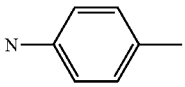 | 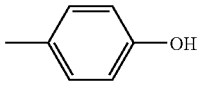 | H |
| 3 | 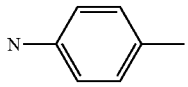 | 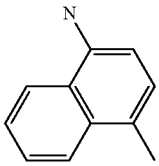 | 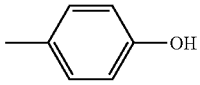 | H |
| 4 | 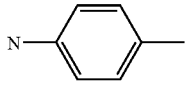 | 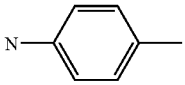 | 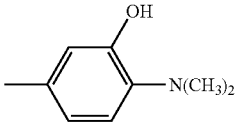 | H |
| 5 | 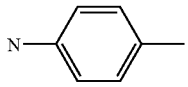 | 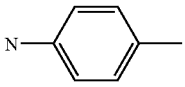 | 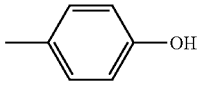 | H |
| 6 | 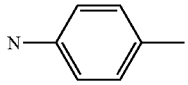 | 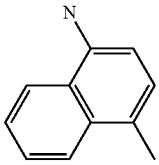 | 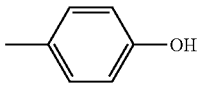 | H |
| 7 | 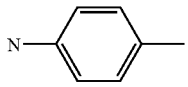 | 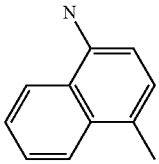 | 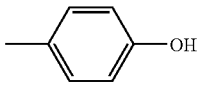 | H |
| 8 | 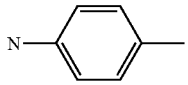 | 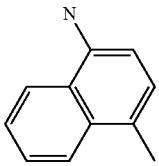 | 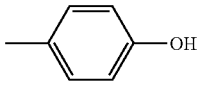 | H |
| 9 | 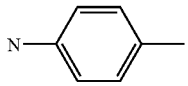 | 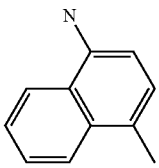 | 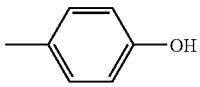 | H |

TABLE 2
| Exemplified compound No. | $Ar^1$ | $Ar^2$ | n | $CR^2{=}CR^3$ | $R^1$ | $N{-}Ar^3{-}$ |
|---|---|---|---|---|---|---|
| 10 | 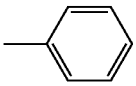 | $-CH_3$ | 0 | CH=CH | H | 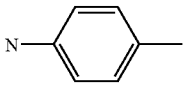 |
| 11 | 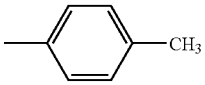 | $-C_2H_5$ | 1 | CH=CH | H | 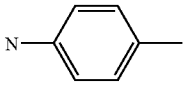 |
| 12 | 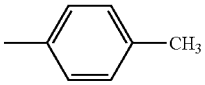 | $-CH(CH_3)_2$ | 1 | CH=CH | H | 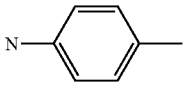 |
| 13 | 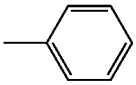 | 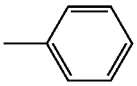 | 1 | CH=CH | H | 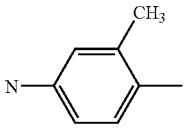 |
| 14 | 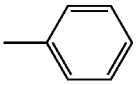 | 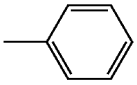 | 1 | CH=CH | H | 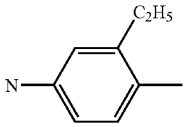 |
| 15 | 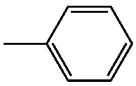 | 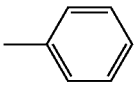 | 1 | CH=CH | H | 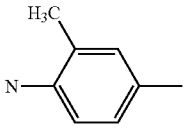 |
| 16 | 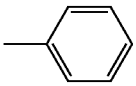 | 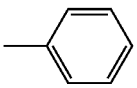 | 1 | CH=CH | H | 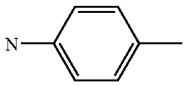 |
| 17 | 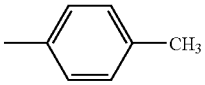 | $-CH_3$ | 1 | CH=CH | $-CH_3$ | 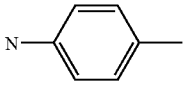 |
| 18 | 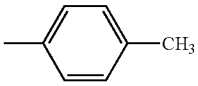 | 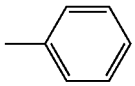 | 1 | CH=CH | $-CH_3$ | 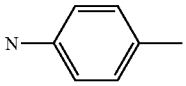 |
| Exemplified compound No. | $N{-}Ar^6{-}$ | $Ar^4$ | $Ar^5$ |
|---|---|---|---|
| 10 | 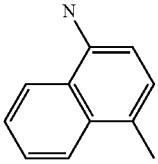 | 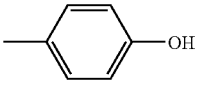 | H |

TABLE 2-continued
| | | | |
|---|---|---|---|
| 11 | 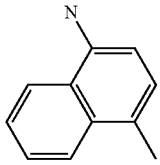 | 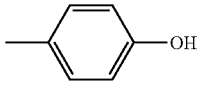 | H |
| 12 | 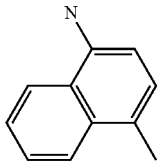 | 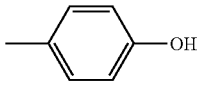 | H |
| 13 | 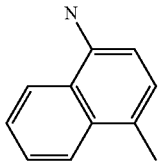 | 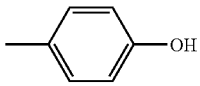 | H |
| 14 | 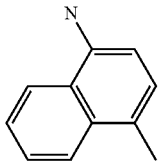 | 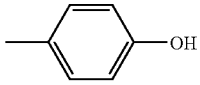 | H |
| 15 | 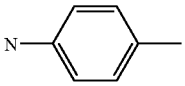 | 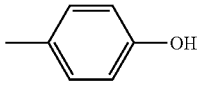 | 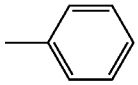 |
| 16 | 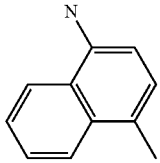 | 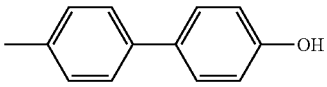 | $—CH_3$ |
| 17 | 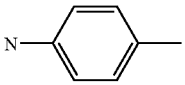 | 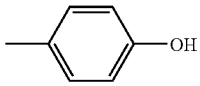 | H |
| 18 | 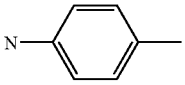 | 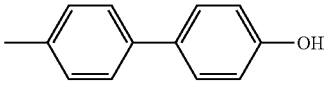 | H |
TABLE 3
| Exemplified compound No. | $Ar^1$ | $Ar^2$ | n | $CR^2{=}CR^3$ | $R^1$ | $N—Ar^3—$ |
|---|---|---|---|---|---|---|
| 19 | 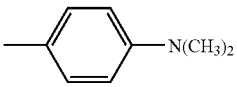 | 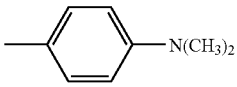 | 1 | CH═CH | H | 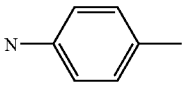 |

TABLE 3-continued
| | | | | | | |
|---|---|---|---|---|---|---|
| 20 | 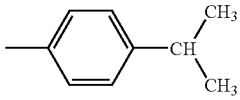 | —$CH_3$ | 1 | CH═CH | H | 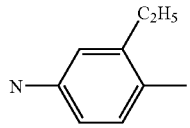 |
| 21 | 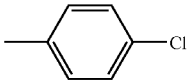 | 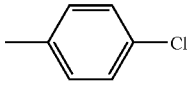 | 1 | CH═CH | H | 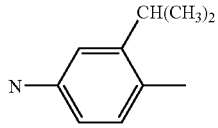 |
| 22 | 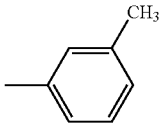 | H | 1 | CH═CH | H | 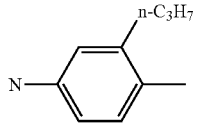 |
| 23 | 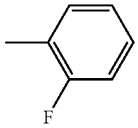 | H | 1 | CH═CH | H | 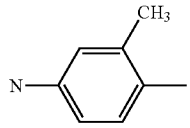 |
| 24 | 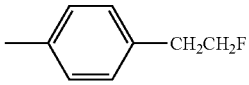 | 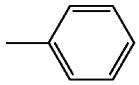 | 1 | CH═CH | 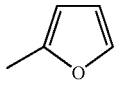 | 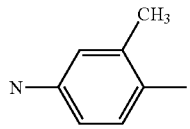 |
| 25 | 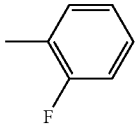 | 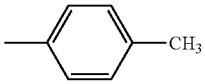 | 1 | CH═CH | H | 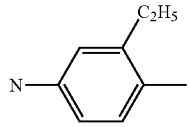 |
| 26 | 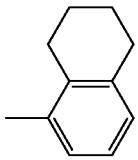 | 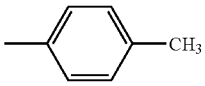 | 1 | CH═CH | H | 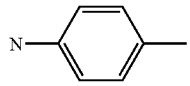 |
| 27 | 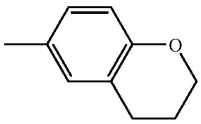 | —$CH_3$ | 1 | CH═CH | H | 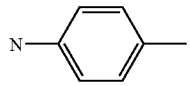 |
| Exemplified compound No. | N—$Ar^6$— | $Ar^4$ | $Ar^5$ |
|---|---|---|---|
| 19 | 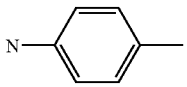 | 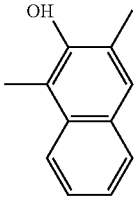 | H |
| 20 | 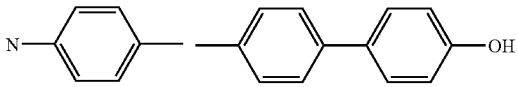 | | H |

TABLE 3-continued
| | | | |
|---|---|---|---|
| 21 | 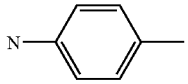 | 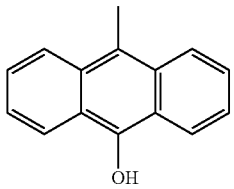 | H |
| 22 | 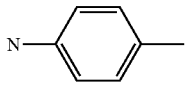 | 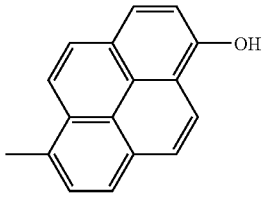 | H |
| 23 | 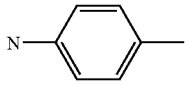 | 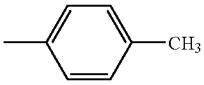 | 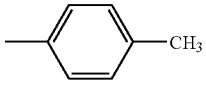 |
| 24 | 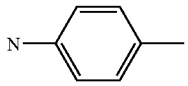 | 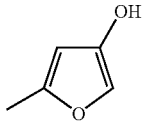 | $—CH_3$ |
| 25 | 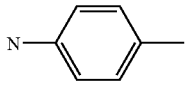 | 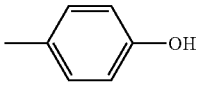 | H |
| 26 | 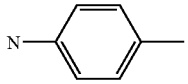 | 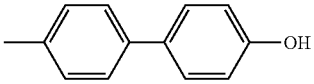 | H |
| 27 | 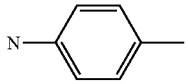 | 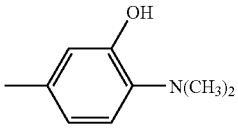 | H |
TABLE 4
| Exemplified compound No. | $Ar^1$ | $Ar^2$ | n | $CR^2{=}CR^3$ | $R^1$ | $N—Ar^3—$ |
|---|---|---|---|---|---|---|
| 28 | 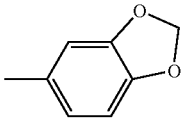 | H | 1 | CH═CH | H | 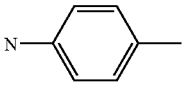 |
| 29 | 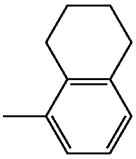 | $—CH_3$ | 2 | CH═CH | $—CH_3$ | 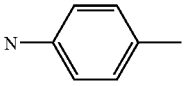 |

TABLE 4-continued
| | | | | | | |
|---|---|---|---|---|---|---|
| 30 | 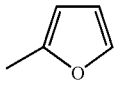 | 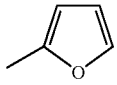 | 1 | CH═CH | H | 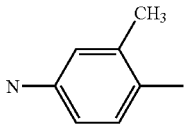 |
| 31 | 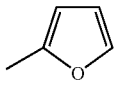 | 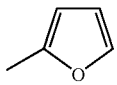 | 2 | CH═CH | H | 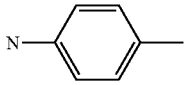 |
| 32 | 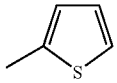 | 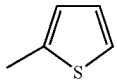 | 1 | CH═CH | H | 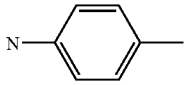 |
| 33 | 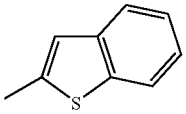 | 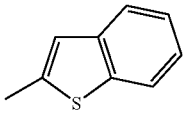 | 1 | CH═CH | 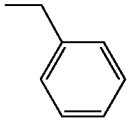 | 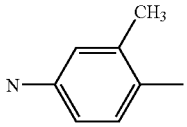 |
| 34 | 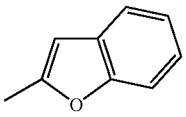 | 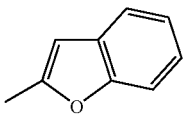 | 1 | CH═CH | H | 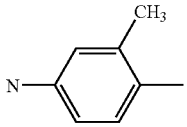 |
| 35 | 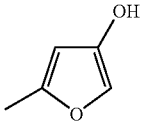 | —$CH_3$ | 1 | CH═CH | H | 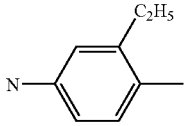 |
| 36 | 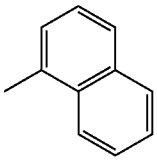 | —$CH_3$ | 1 | CH═CH | H | 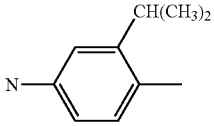 |
| Exemplified compound No. | N—$Ar^6$— | $Ar^4$ | $Ar^5$ |
|---|---|---|---|
| 28 | 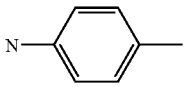 | 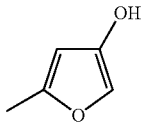 | H |
| 29 | 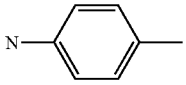 | 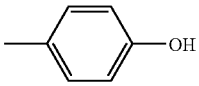 | H |
| 30 | 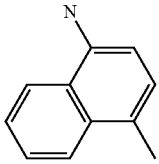 | 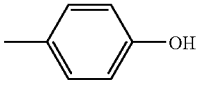 | H |
| 31 | 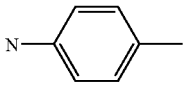 | 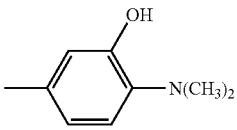 | H |

TABLE 4-continued
| | | | |
|---|---|---|---|
| 32 | 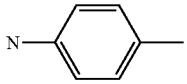 | 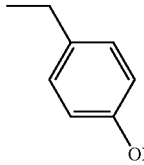 | 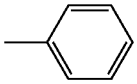 |
| 33 | 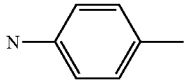 | 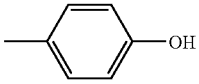 | 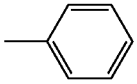 |
| 34 | 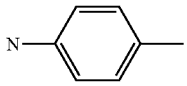 | 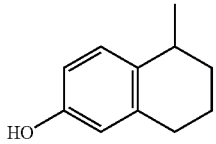 | |
| 35 | 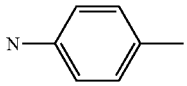 | 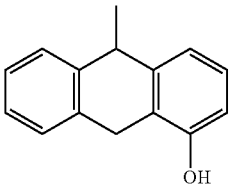 | |
| 36 | 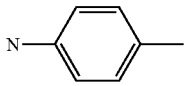 | 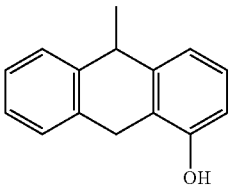 | |
TABLE 5
| Exemplified compound No. | $Ar^1$ | $Ar^2$ | n | $CR^2{=}CR^3$ | $R^1$ |
|---|---|---|---|---|---|
| 37 | 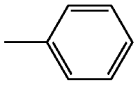 | $-CH_3$ | 1 | CH═CH | H |
| 38 | 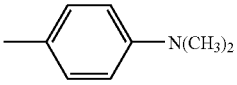 | H | 2 | CH═CH | $-CH_3$ |
| 39 | 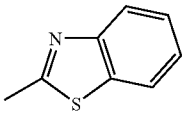 | $-CH_3$ | 1 | CH═CH | $-CH_3$ |
| 40 | 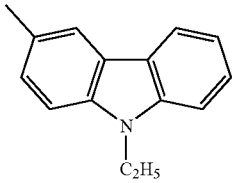 | $-CH_3$ | 1 | CH═CH | 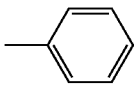 |

TABLE 5-continued
| | | | | | |
|---|---|---|---|---|---|
| 41 | 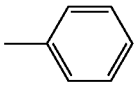 | H | 2 | CH═CH | H |
| 42 | 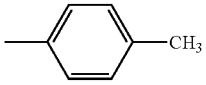 | H | 1 | 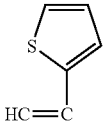 | H |
| 43 | 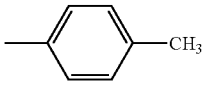 | 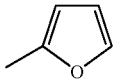 | 1 | 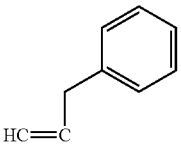 | H |
| 44 | 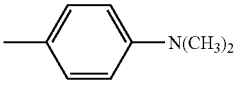 | 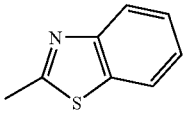 | 1 | 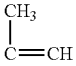 | H |
| 45 | 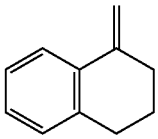 | | 1 | 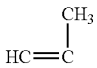 | —$CH_3$ |
| Exemplified compound No. | N—Ar³— | N—Ar⁶— | Ar⁴ | Ar⁵ |
|---|---|---|---|---|
| 37 | 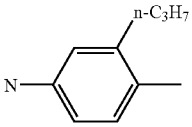 | 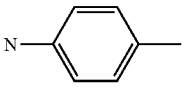 | 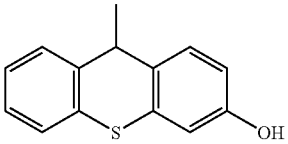 | |
| 38 | 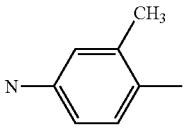 | 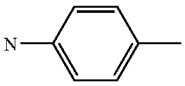 | 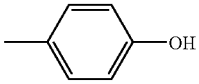 | H |
| 39 | 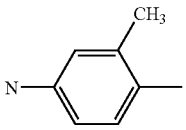 | 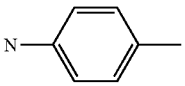 | 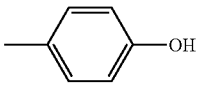 | H |
| 40 | 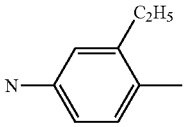 | 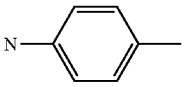 | 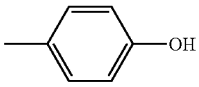 | H |
| 41 | 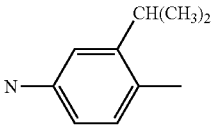 | 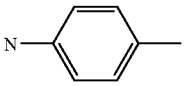 | 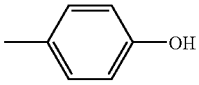 | H |

TABLE 5-continued
| | | | | |
|---|---|---|---|---|
| 42 | 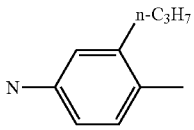 | 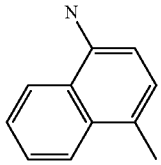 | 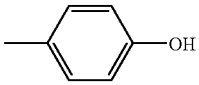 | H |
| 43 | 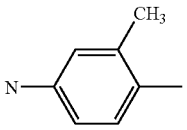 | 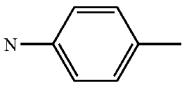 | 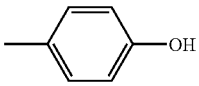 | H |
| 44 | 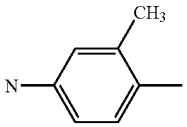 | 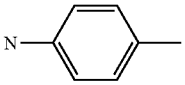 | 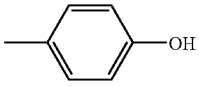 | H |
| 45 | 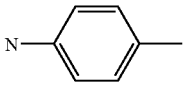 | 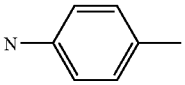 | 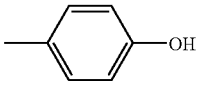 | H |
TABLE 6
| Exemplified compound No. | $Ar^1$ | $Ar^2$ | n | $CR^2{=}CR^3$ | $R^1$ | $N{-}Ar^3{-}$ |
|---|---|---|---|---|---|---|
| 46 | 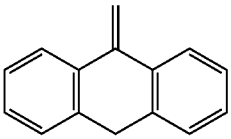 | | 2 | 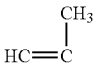 | 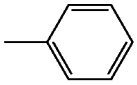 | 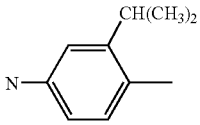 |
| 47 | 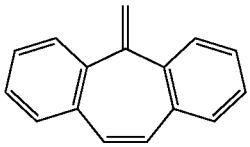 | | 2 | 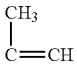 | H | 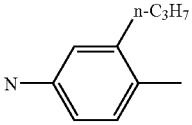 |
| 48 | 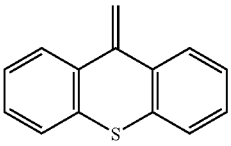 | | 2 | 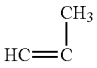 | H | 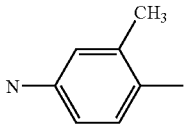 |
| 49 | 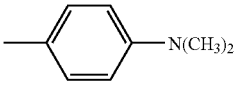 | H | 2 | 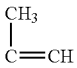 | H | 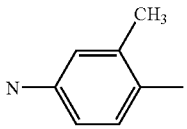 |
| 50 | 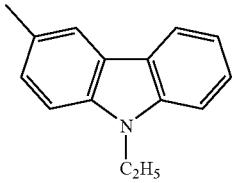 | H | 2 | 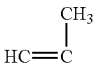 | H | 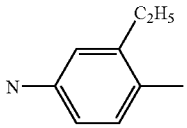 |

TABLE 6-continued
| | | | | | | |
|---|---|---|---|---|---|---|
| 51 | 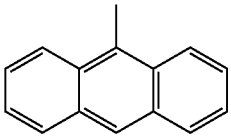 | H | 2 | 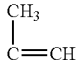 | H | 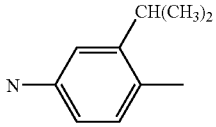 |
| 52 | 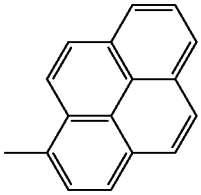 | H | 2 | 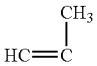 | H | 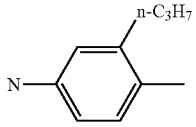 |
| 53 | 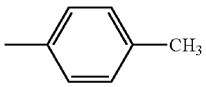 | —$CH_3$ | 2 | 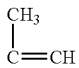 | H | 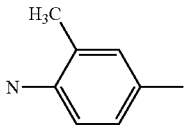 |
| 54 | 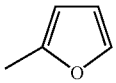 | —$CH_3$ | 2 | 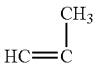 | H | 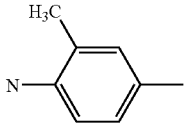 |
| Exemplified compound No. | N—$Ar^6$— | $Ar^4$ | $Ar^5$ |
|---|---|---|---|
| 46 | 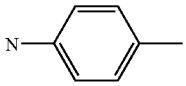 | 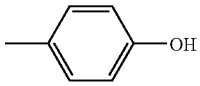 | H |
| 47 | 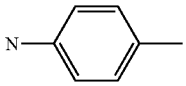 | 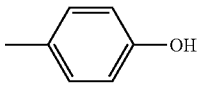 | H |
| 48 | 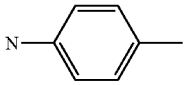 | 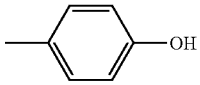 | —$CH_3$ |
| 49 | 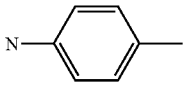 | 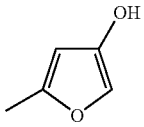 | —$CH_3$ |
| 50 | 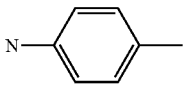 | 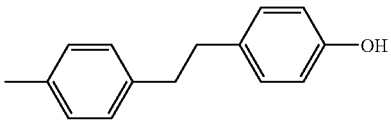 | —$CH_3$ |
| 51 | 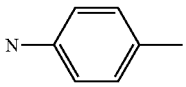 | 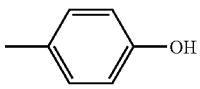 | —$CH_3$ |
| 52 | 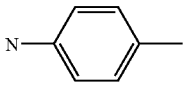 | 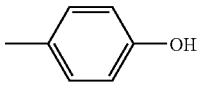 | H |

TABLE 6-continued

| | | | |
|---|---|---|---|
| 53 | 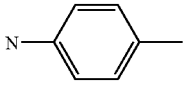 | 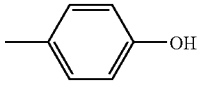 | H |
| 54 | 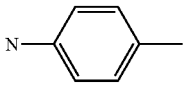 | 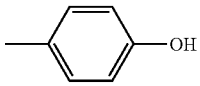 | H |

TABLE 7

| Exemplified compound No. | $Ar^1$ | $Ar^2$ | n | $CR^2{=}CR^3$ | $R^1$ | $N{-}Ar^3{-}$ | $N{-}Ar^6{-}$ | $Ar^4$ | $Ar^5$ |
|---|---|---|---|---|---|---|---|---|---|
| 55 | 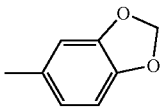 | $-CH_3$ | 2 | CH=CH | H | 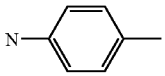 | 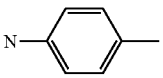 | 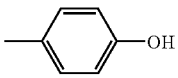 | H |
| 56 | 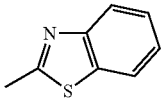 | $-CH_3$ | 2 | 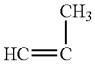 | H | 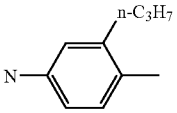 | 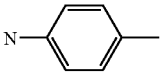 | 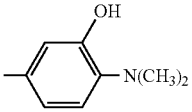 | H |
| 57 | 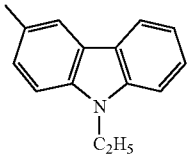 | H | 2 | 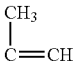 | H | 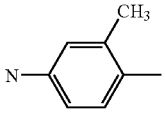 | 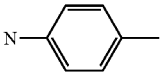 | 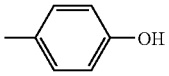 | H |
| 58 | 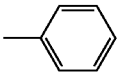 | H | 2 | 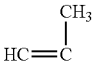 | H | 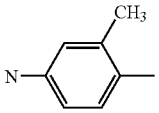 | 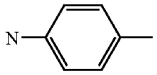 | 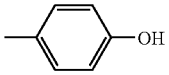 | H |
| 59 | 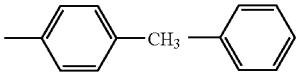 | | 1 | 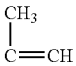 | H | 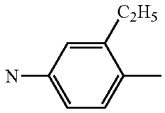 | 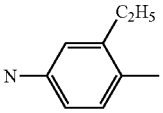 | 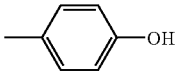 | H |
| 60 | 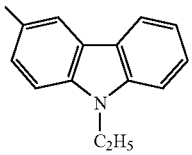 | | 1 | CH=CH | H | 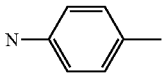 | 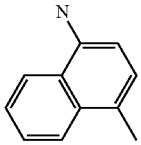 | 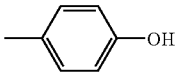 | H |

(Carbonate Compound)

Further, in the production of the aromatic polycarbonate of the invention, as the carbonate compound used together with the asymmetric bishydroxy compound, any compound used for the production of polycarbonate can be used and examples thereof include bisarylcarbonates, such as bisphenyl carbonate, halogenated formates such as bischloroformate, halogenated carbonates such as phosgene, trichloromethyl chloroformate (phosgene dimer), bis(trichloromethyl) carbonate (phosgene trimer) and phosgene trimer. The phosgene trimer is advantageous in that it is stable thermally and chemically and easy for reaction control and handling. Further, the halogenated formates can be derived from the following dihydroxy compounds.

Further, in the production of the aromatic polycarbonate of the invention, the dihydroxy compound used together with the asymmetric bishydroxy compound and the carbonate compound includes, for example, a dihydroxy compound represented by the general formula:

$$HO{-}X{-}OH \tag{14}$$

(where X has the same meanings as described above) (hereinafter often referred to as "dihydroxy compound (14)"). The mechanical strength of the aromatic polycarbonate including the constituent unit (1) and the constituent unit (2) obtained by using the dihydroxy compound (14) is further improved than the mechanical strength of the aromatic polycarbonate containing only the constituent unit (1).

Specific examples of the dihydroxy compounds (14) include 4,4'-1-methylethylidene)bisphenol, 4,4'-(1-methylethylidene)bis(2-methylphenol), 4,4'-cyclohexylidene bisphenol, 4,4'-ethylidene bisphenol, 4,4'-(1,3-dimethylbutylidene)bisphenol, 4,4'-(1-metehylethylidene)bis(2,6-dimethylphenol), 4,4'-(1-phenyl ethylidene)bisphenyl, 4,4-(2-ethylhexylidene) bisphenyl, 5,5-(1-methylethylidene)(1,1'-biphenyl)-2-ole, 1,1'-biphenyl-4,4'-diol, 4,4'-methylidenebisphenol, 4,4'-methylenebis[2-(2-propenyl) phenol], 4,4'-methylidene bis(2-methylphenol), 4,4'-propanediylbisphenol, 4,4'-1-methylpropylidene)bisphenol, 4,4'-(2-methylpropylidene) bisphenol, 4,4'-(3-methylbutylidene)bisphenol, 4,4'-cyclopentylidene bisphenol, 4,4'-(phenylmethylidene) bisphenol, 4,4'-(1-methylheptylidene) bisphenol, 4,4'-cyclohexylidene bis(3-methylphenol), 4,4'-(1-methylethylidene)bis[2-(2-propenyl)phenol], 4,4'-(1-methylethylidene)bis[2-(1-methylethyl)phenol], 4,4'-(1-methyloctylidene)bisphenol, 4,4'-(1-phenylethylidene)bis (2-methylphenol), 4,4'-cyclohexylidene bis(2,6-dimethylphenol), 4,4'-(1-methyl)nonylidene bisphenol, 4,4'-decylidene bisphenol, 4,4'-(1-methylethylidene) bis[2-(1,1-methylpropyl)phenol], 4,4'-(1-methylethylidene)bis[2-(1,1-dimethylethyl)phenol], 4,4'-(diphenylmethylidene) bisphenol, 4,4'-cyclohexylidene bis[2-(1,1-dimethylethyl) phenol], 4,4'-(2-methylpropylidene)bis(3-methyl-6-(1,1-dimethylethyl)phenol, 4,4'-(1-methylethylidene)bis(2-cyclohexylphenol), 4,4'-methylene-bis[2,6-bis(1,1-dimethylethyl)phenol], 4,4'-methylene bis(2,6-di-sec-butylphenol) 5,5'-(1,1-cyclohexylidene)bis-(1,1'-bisphenyl)-2-ole, 4,4'-cyclohexylidene bis(2-cyclohexylphenol), 2,2'-methylene bis(4-nonylphenol), 4,4'-(1-methylethylidene)bis [2,6-bis(1,1-dimethylethylphenol], 5,5'-(1-phenolethylidene) (1,1'-biphenyl)-2-ole, bis(4-hydroxyphenyl)methanone, 4,4'-methylene bis(2-fluorophenol), 4,4'-[2,2,2-trifluoro-1-(trifluoromethyl) ethylidene]bisphenol, 4,4'-isopropylidene bis(2-fluorophenol), 4,4'-[(4-fluorophenyl)methylene]bis(2-fluorophenol), 4,4'-(phenylmethylene)bis(2-fluorophenol), 4,4'-[(4 fluorophenyl)methylene]bisphenol, 4,4'-1-methylethylidene)bis(2-chloro-6-methylphenol), 4,4'-(1-methylethylidene)bis(2,6-dichlorophenol), 4,4'-(1-methylethylidene)bis(2-chlorophenol), 4,4'-methylenebis(2,6-dibromophenol), 4,4'-(1-methylethylidene)bis(2,6-dibromophenol), 4,4'-(1-methylethylidene)bis(2-nitrophenol), 3,3'-dimethyl-1,1'-biphenyl-4,4-diol, 3,3',5,5'-tetramethyl-1,1'-biphenyl-4,4'-diol, 3,3'-5,5'-tetra-t-butyl-1,1'-biphenyl-4,4'-diol, 3,3'-difluoro-1,1'-biphenyl-4,4'-diol, and 3,3'-5,5'-tetrafluoro-1,1'-biphenyl-4,4'-diol. Two or more of the dihydroxy compounds (14) may be used in combination. Particularly, with a view point of the reactivity, 4,4'-(1-methylethylidene)bisphenol, 4,4'-(1-methylethylidene)bis (2-methylphenol), and 4,4'-cyclohexylidene bisphenol are preferred.

[Polymerization Method]

The polymerization method for the asymmetric bishydroxy compound and the carbonate compound and the polymerization method for the asymmetric dihydroxy compound, the carbonate compound, and the dihydroxy compound can be conducted in accordance with known methods described, for example, in "Plastic Material Session: Polycarbonate Resin" (written by Mikio Matsugane, Shogo Tahara, and Shuji Kato, published from Nikkan Kogyo Shinbunsha in 1969). For example, in a case of using halogenated carbonates as the carbonate compound, an aromatic polycarbonates can be obtained by an interfacial polymerization or solution polymerization method. Further, in a case of using bisarylcarbonates as the carbonate compound, aromatic polycarbonate can be obtained by an ester exchange method.

(Interfacial Polymerization Method)

According to the interfacial polymerization method, the aromatic polycarbonate of the invention can be produced by mixing an aqueous phase containing an asymmetric bishydroxy compound and an oil phase containing a carbonate compound and a polycarbonate forming catalyst and, optionally, a dihydroxy compound and polymerizing them between the two phases.

The asymmetric bishydroxyl compound can be dissolved in water in an alkaline region. Usual bases can be used for rending water alkaline. Known bases can be used and examples thereof include hydroxides of alkali metals or alkaline earth metals such as sodium hydroxide, potassium hydroxide, and calcium hydroxide; and carbonates of alkali metals or alkaline earth metals such as sodium carbonate, potassium carbonate, calcium carbonate, and sodium hydrogen carbonate. Among them, alkali metal hydroxides such as sodium hydroxide, and potassium hydroxide are preferred. The bases can be used each alone or two or more of them can be used in combination. Water used herein is distilled water or ion exchanged water. The aqueous phase may contain an aqueous medium such as an alcohol. The amount of use for the base may be such that the entire amount of the asymmetric bishydroxy compound used is dissolved stably to water used.

As the organic solvent constituting the oil phase, those used customarily in this field, that is, those having a solubility to water is at such a low level as not giving undesired effects on the polymerization reaction and capable of dissolving the formed aromatic polycarbonate can be used and examples thereof include halogenated aliphatic hydrocarbons such as dichloromethane, 1,2-dichloroethane, 1,2-dichloroethylene, trichloroethane, tetrachloroethane, and dichloropropane; halogenated aromatic hydrocarbons such as chlorobenzene and dichlorobenzene; mixtures of two or more of halogenated aliphatic hydrocarbons; mixtures of two or more of halogenated aromatic hydrocarbons; and mixtures of one or more of halogenated aliphatic hydrocarbons and mixtures of one or more of halogenated aromatic hydrocarbons. Among them, dichloromethane and chlorobenzene are preferred. Further, one or more compounds selected from aromatic hydrocarbons such as toluene, xylene, and ethylbenzenene and cycloaliphatic hydrocarbons such as hexane and cyclohexane may be mixed to the organic solvent described above. While the amount of use for the organic solvent is not particularly restricted, such an amount as smoothly proceeding the polymerization reaction may be properly selected in accordance with reaction conditions such as the type and the amount of use for each of the monomers, the type of the organic solvent, the reaction temperature, the reaction time, etc.

Also for the polycarbonate forming catalyst, those customarily used in this field can be used and examples thereof include tertiary amines, quaternary ammonium salts, tertiary phosphines, quaternary phosphonium salts, nitrogen-containing heterocyclic compounds and salts thereof, iminoethers and salts thereof, and amide groups containing compounds. Among them, tertiary amines are preferred and tertiary amines of 3 to 30 carbon atoms are more preferred, and triethylamines are particularly preferred. The addition timing of the polycarbonate forming catalyst to the reaction system may be either before or after the addition of the carbonate compound to the reaction system, or may be added twice before and after the addition. While the ratio of using the asymmetric bishydroxy compound, the dihydroxy compound, and the carbonate compound is not particularly restricted and it is preferably set such that the molar ratio between the structural unit (1) and the structural unit (2) can provide the aromatic polycarbonate within the range described above.

In the interfacial polymerization reaction, the molecular weight can be controlled by the following method. This is, for example, a method of tracing the molecular weight of the formed polycarbonate, and adding a terminal blocking agent as a molecular weight controller to the reaction system at the instance the desired molecular weight is obtained to thereby control the molecular weight. Also for the terminal blocking agent, those used customarily in this field can be used and examples thereof include monovalent aromatic hydroxy compound, haloformate derivative of monovalent aromatic hydroxy compound, monovalent carboxylic acid, and halide derivatives of monovalent carboxylic acid. Among them, the monovalent aromatic hydroxy compound is preferred and phenol, p-tert-buthylphenol, p-cumylphenol are further preferred. In a case of using the terminal blocking agent, monovalent substituents derived from the terminal blocking agent are usually bonded to the C terminal end and the O terminal end of the obtained aromatic polycarbonate.

In the interfacial polymerization reaction, a branching agent may also be added by an appropriate amount for further improving the mechanical property of the obtained aromatic polycarbonate. Also for the branching agent, those used customarily in this field can be used and examples thereof include compounds having three or more identical or different types of reactive group selected from phenolic hydroxy group, haloformate group, carbonic acid group, carbonic halide group, and active halogen atoms.

In the interfacial polymerization reaction, an aromatic polycarbonate with a narrow molecular weight distribution can also be obtained in a short time by conducting the reaction by emulsifying the reaction medium by high speed stirring, addition of an emulsifier, etc.

The interfacial polymerization reaction is conducted, for example, at a temperature from 0 to 40° C. and completed within about several min to 5 hrs. Further, the pH of the aqueous phase is preferably kept at 10 or higher, for example, by the addition of a base.

(Solution Polymerization Method)

Further, according to the solution polymerization method, an aromatic polycarbonate can be produced by polymerizing monomers comprising an asymmetric bishydroxy compound, a carbonate compound and, optionally, a dihydroxy compounds in an appropriate solvent under the presence of an acid removing agent. More specifically, an aromatic polycarbonate can be obtained by dissolving an asymmetric bishydroxy compound and, optionally, a dihydroxy compound in a solvent, adding an acid removing agent to the solution, further, adding a carbonate compound such as bischloroformate, phosgene, phosgene dimer or trimer, and phosgene multimer, and conducting the polymerization reaction. While the ratio of using the asymmetric bishydroxy compound, the dihydroxy compound, and the carbonate compound is not particularly restricted, it is preferably set such that the molar ratio between the structural unit (1) and the structural unit (2) can provide the aromatic polycarbonate within the range described above. For the solvent, those customarily used in this field, inert to the polymerization reaction, and capable of dissolving or dispersing the three kinds of the monomers and the acid removing agent can be used and examples thereof include halogenated hydrocarbons such as dichloromethane, dichloroethane, trichloroethane, tetrachloroethane, trichloroethylene, and chloroform, cyclic ethers such as tetrahydrofuran and dioxane, and pyridine. Also for the acid removing agent, those used customarily in this field can be used and examples thereof include tertiary amine such as trimethylamine, triethylamine, and tripropylamine, and pyridine. Further, in the same manner as in the interfacial polymerization, molecular weight controller, branching agent, etc. can be added. The method is conducted usually at a temperature of from 0 to 40° C. and completed in about several min to 5 hrs.

(Ester Exchange Method)

Further, according to the ester exchange method, an aromatic polycarbonate is obtained, for example, by mixing an asymmetric bishydroxy compound and a bisarylcarbonate (carbonate compound) and, optionally, a dihydroxy compound in an inert gas atmosphere, and reacting them usually under a reduced pressure at a temperature of 120 to 350° C. It is preferred to change the degree of pressure reduction stepwise to lower the pressure finally to 1 mmHg, and distill off phenols as a by-product to the outside of the system. The reaction time is usually about from 1 to 4 hrs. Further, optionally, a molecular weight controller, antioxidant, etc. may also be added.

Further, in each of the polymerization reactions, a random copolymer, alternating copolymer, block copolymer, random alternating copolymer, or random block copolymer can be produced selectively by properly selecting the polymerization operation. For example, a random copolymer is obtained by uniformly mixing an asymmetric bishydroxy compound and a dihydroxy compound and then subjecting them to condensation reaction with a carbonate compound such as phosgene. A random block copolymer is obtained by further adding several types of asymmetric hydroxy compounds in the course of the polymerization reaction. An alternating copolymer is obtained by conducting condensation reaction for the bischloroformate derived from the dihydroxy compound and an asymmetric bishydroxy compound. On the contrary, an alternating copolymer is obtained in the same manner also by condensation reaction between a bischloroformate derived from an asymmetric hydroxy compound and a dihydroxy compound. A random alternating copolymer is obtained by condensation reaction using two or more kinds of bischloroformates and an asymmetric bishydroxy compound or the dihydroxy compound.

The aromatic polycarbonate of the invention obtained as described above can easily be isolated and purified from the reaction mixture after the completion of the polymerization reaction by a usual purification apparatus such as extraction, chromatography, centrifugal separation, recrystallization, or cleaning.

One or more of substances selected from usual resin additives such as antioxidants, light stabilizers, heat stabilizers, lubricants, and plasticizers can be added optionally to the aromatic polycarbonate of the invention.

[Electrophotographic Photoreceptor]

FIGS. 1 to 8 are cross sectional views schematically showing the constitution of main portions of electrophotographic photoreceptors as embodiments of the invention. Electrophotographic photoreceptors shown in FIGS. 1 to 4 are single layer type electrophotographic photoreceptors each comprising one photosensitive layer 2. Further, electrophotographic photoreceptors shown in FIGS. 5 to 8 are function separation type or layered type electrophotographic photoreceptors in which a photosensitive layer 2*a* comprises a charge generating layer 3 and a charge transporting layer 4.

An electrophotographic photoreceptor shown in FIG. 1 includes a conductive substrate (a base pipe for electrophotographic photoreceptor) 1 and a photosensitive layer 2 formed on one surface of the conductive substrate 1.

Figure 2:
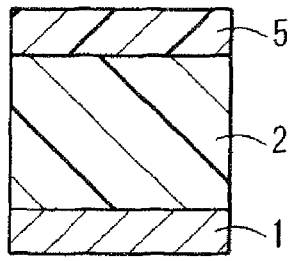
FIG. 2 is a cross sectional view schematically showing the constitution for a main portion of a single layer type electrophotographic photoreceptor of the invention.

An electrophotographic photoreceptor shown in FIG. 2 includes a conductive substrate 1, a photosensitive layer 2 formed on the surface of the conductive substrate 1, and a surface protection layer 5 formed on the surface of the photosensitive layer 2.

Figure 3:
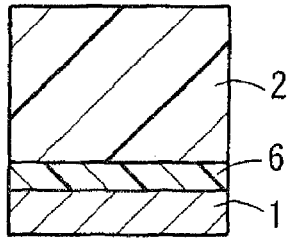
FIG. 3 is a cross sectional view schematically showing the constitution for a main portion of a single layer type electrophotographic photoreceptor of the invention.

An electrophotographic photoreceptor shown in FIG. 3 includes a conductive substrate 1, an undercoat layer 6 formed on the conductive substrate 1, and a light sensitive layer 2 formed on the undercoat layer 6.

Figure 4:
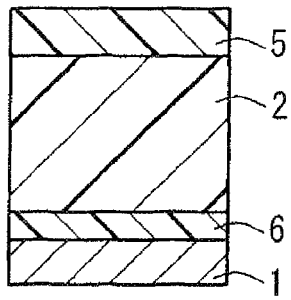
FIG. 4 is a cross sectional view schematically showing the constitution for a main portion of a single layer type electrophotographic photoreceptor of the invention.

An electrophotographic photoreceptor shown in FIG. 4 includes a conductive substrate 1, an undercoat layer 6 formed on the surface of the conductive substrate 1, a photosensitive layer 2 formed on the surface of the undercoat layer 6, and a surface protection layer 5 formed on the surface of the photosensitive layer 2.

Figure 5:
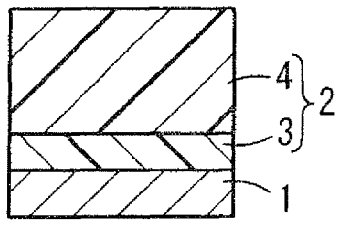
FIG. 5 is a cross sectional view schematically showing the constitution for a main portion of a layered type electrophotographic photoreceptor of the invention.

An electrophotographic photoreceptor shown in FIG. 5 includes a conductive substrate 1, a charge generating layer 3 formed on the surface of the conductive substrate 1, and a charge transporting layer 4 formed on the surface of the charge generating layer 3.

Figure 6:
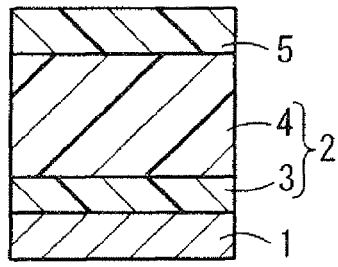
FIG. 6 is a cross sectional view schematically showing the constitution for a main portion of a layered type electrophotographic photoreceptor of the invention.

An electrophotographic photoreceptor shown in FIG. 6 includes a conductive substrate 1, a charge generating layer 3 formed on the surface of the conductive substrate 1, a charge transporting layer 4 formed on the surface of the charge generating layer 3, and a surface protection layer 5 formed on the surface of the charge transporting layer 4.

Figure 7:
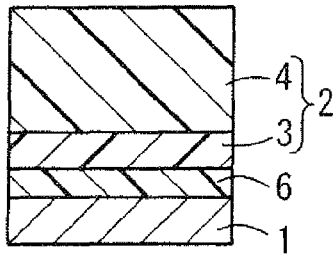
FIG. 7 is a cross sectional view schematically showing the constitution for a main portion of a layered type electrophotographic photoreceptor of the invention.

An electrophotographic photoreceptor shown in FIG. 7 includes a conductive substrate 1, an undercoat layer 6 formed on the surface of the conductive substrate 1, a charge generating layer 3 formed on the surface of the undercoat layer 6, and a charge transporting layer 4 formed on the surface of the charge generating layer 3.

Figure 8:
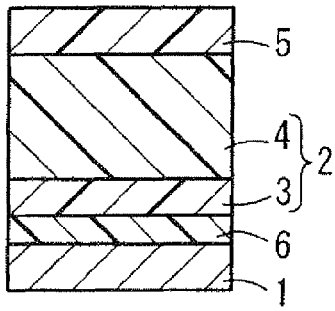
FIG. 8 is a cross sectional view schematically showing the constitution for a main portion of a layered type electrophotographic photoreceptor of the invention.

An electrophotographic photoreceptor shown in FIG. 8 includes, a conductive substrate 1, an undercoat layer 6 formed on the surface of the conductive substrate 1, a charge generating layer 3 formed on the surface of the undercoat layer 6, a charge transporting layer 4 formed on the surface of the charge generating layer 3, and a surface protection layer 5 formed on the surface of the charge transporting layer 4.

Each of the layers constituting the electrophotographic photoreceptors shown in FIGS. 1 to 8 is, specifically, as described below.

(Conductive Substrate)

The conductive substrate 1 is formed, for example, of a metal material such as aluminum, aluminum alloy, copper, zinc, stainless steel, and titanium. Further, the metal materials are not restrictive, but substrates comprising, for example, synthetic resins such as polyethylene terephthalate, polyester, polyoxymethylene, or polystyrene, hard paper, or glass in which a metal foil is laminated, a metal material is vapor deposited, or a layer of a conductive compound such as conductive polymer, tin oxide, indium oxide, carbon particles, and metal particles are vapor deposited or coated to the surface of the substrate can also be used. The surface of the conductive substrate 1 may optionally be applied with an anodized film treatment, a surface treatment with chemicals or hot water, a coloration treatment, or random reflection treatment such as surface roughening within a range giving no adverse effects to the image quality. The random reflection treatment is particularly effective in a case of using an electrophotographic photoreceptor of the invention in an electrophotographic process using a laser as an exposure light source. That is, in the electrophotographic process using a laser as an exposure light source, since the wavelength of the laser light is coherent, an incident laser light and a light reflected in the electrophotographic photoreceptor may sometimes cause interference and interference fringes due to the interference may sometimes appear on images to cause image defects. By applying the random reflection treatment descried above to the surface of the conductive substrate, it is possible to prevent image defects due to the interference of the laser light of coherent waveform.

(Photosensitive Layer)

The photosensitive layer 2 is formed including a charge generating substance and an aromatic polycarbonate of the invention. In the photosensitive layer 2, the aromatic polycarbonate functions as a charge transporting substance and a binder resin. The photosensitive layer 2 may also contain optionally a charge transporting substance other than the aromatic polycarbonate of the invention, a binder resin other than the aromatic polycarbonate of the invention, and an antioxidant. The aromatic polycarbonate of the invention is contained within a range preferably from 50 to 100% by weight in the photosensitive layer 2. The charge generating substance is a material for generating electric charges by light absorption. As the charge generating substance, those used customarily in this field can be used and examples thereof include organic pigments and dyes such as azo pigments, (monoazo pigments, bisazo pigments, trisazo pigments, etc.) indigo pigments (indigo, thioindigo, etc.), perylene pigments (perylene imide, perylenic acid anhydride, etc.), polynuclear quinone pigments (anthraquinone, pyrene quinone, etc.), phthalocyanine pigments (metal phthalocyanine, non-metal phthalocyanine, etc.), tripheylmetehane dyes (methyl violet, crystal violet, night blue, Victoria blue, etc.), acridine dyes (erythrosine, rhodamine B, rhodamine 3R, acridine orange, frapeosine, etc.), thiadine dyes (methylene blue, methylene green, etc.), oxadine dyes (capri blue, merdra blue, etc.), squalirium dyes, pyrylium salts, thio pyrylium salts, thioindigo dyes, bisbenzoimidazole dyes, quinacrydone dyes, quinoline dyes, lake dyes, azo lake dye, dioxadine dyes, azulenium dyes, triarylmethane dyes, xanethene dyes, and cyanine dyes, as well as inorganic materials such as amorphous silicon, amorphous selenium, tellurium, selenium-tellurium alloy, cadmium sulfide, antimony sulfide, zinc oxide and zinc sulfide. Charge generating substances are used each alone or two or more of them in combination.

As the aromatic polycarbonate of the invention, one or more compounds selected from homopolymers of the constituent unit (1) and copolymers containing the constituent unit (1) and the constituent unit (2) can be used.

The charge transporting substance other than the aromatic polycarbonate of the invention is used, for example, for further improving the electric property of the photosensitive layer 2. The material includes a hole transporting substance and an electron transporting substance.

For the hole transporting substance, those customarily used in this field can be used and examples thereof include carbazole derivatives, pyrene derivatives, oxazole derivatives, oxadiazole derivatives, thiazole derivatives, thiadiazole derivatives, triazole derivatives, imidazole derivatives, imidazolon derivatives, imidazolidine derivatives, bisimidazolidine derivatives, styryl compounds, hydrazone compounds, polynuclear aromatic compounds, indole derivatives, pirazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylene diamine derivatives, stilbene derivatives, enamine derivatives, benzidine derivatives, polymers having groups derived from the compounds in the main chain or on the side chains (poly-N-vinylcarbazole, poly-1-vinylpyrene, ethylcarbazole-formaldehyde resin, triphenylmetane polymer, poly-9-vinylanthracene, etc.) and polysilane. Also for the electron transporting substance, those customarily used in this field can be used and, examples thereof include organic compounds such as benzoquinone derivatives, tetracyanoethylene derivatives, tetracyanoquinodimethane derivatives, fluolenone derivatives, xanthone derivatives, phenanthraquinone derivatives, phthalic acid anhydride derivatives, and diphenoquinone derivatives; and inorganic materials such as amorphous silicon, amorphous selenium, tellurium, selenium-tellurium alloy, cadmium sulfide, antimony sulfide, zinc oxide, and zinc sulfide. The charge transporting substances can be used each alone or two or more of them in combination.

The binder resin other than the aromatic polycarbonate of the invention is used, for example, for improving the mechanical strength and the durability of the photosensitive layer 2. For the binder resin, those having excellent compatibility with the aromatic polycarbonate of the invention are used preferably. Specific examples thereof include thermoplastic resins, such as polymethylmethacrylate, polystyrene, vinylic resin (e.g., polyvinyl chloride), polycarbonate, polyester, polyester carbonate, polysulfone, polyarylate, polyamide, methacrylic resin, acrylic resin, polyether, polyacrylamide, and polyphenylene oxide; thermosetting resins such as phenoxy resin, epoxy resin, silicone resin, polyurethane and phenol resin; and partially crosslinked products of such resins. Among them, polystyrene, polycarbonate, polyarylate, and polyphenylene oxide can be used suitably as the binder resins, since they are excellent in the electric insulation property having a volume resistivity of $10^{13}\Omega$ or higher and also excellent in the layer forming property, potential property, etc. Further, the polycarbonate is used particularly suitably. The binder resin other than the aromatic polycarbonate of the invention can be used each alone or two or more of them in combination.

The antioxidant can decrease the deterioration of the surface layer due to deposition of active materials such as ozone or $NO_x$, generated upon charging of the electrophotographic photoreceptor to improve the durability of the electrophotographic photoreceptor during repetitive use. Further, the antioxidant can improve the stability of the coating solution for forming the photosensitive layer to be described later to extend the life of the solution. In addition, since impurities are decreased, the durability of the electrophotographic photoreceptor produced with the coating solution can also be improved.

Examples of the antioxidant include hindered phenol derivatives and hindered amine derivatives. While the amount of use for the antioxidant is not particularly restricted, it is preferably from 0.1 to 10 parts by weight based on 100 parts by weight of the charge transporting substance. In a case where the amount of use for the antioxidant is less than 0.1 part by weight, it is not preferred since the effect of improving the stability of the coating solution for forming the photosensitive layer to be described later and the durability of the electrophotographic photoreceptor become insufficient. Further, in a case where the amount exceeds 10 parts by weight, it is not preferred since this sometimes gives undesired effects on the electric property of the electrophotographic photoreceptor.

The photosensitive layer 2 can be formed by dissolving and/or dispersing a charge generating substance and an aromatic polycarbonate of the invention, optionally, a charge transporting substance other than the aromatic polycarbonate of the invention, a binder resin other than the aromatic polycarbonate of the invention, an antioxidant, etc. in an appropriate organic solvent to prepare a coating solution for forming a photosensitive layer, coating the coating solution on the surface of the conductive substrate 1 or the undercoat layer 6 to be described later, and drying the same to remove the organic solvent.

Examples of the organic solvent include aromatic hydrocarbons such as benzene, toluene, xylene, mesitylene, tetrahydronaphthalene, diphenylmethane, dimethoxybenzene and dichlorobenzene; halogenated hydrocarbons such as dichloromethane, and dichloroethane, ethers such as tetrahydrofuran (THF), dioxane, dibenzylether, and dimethoxymethyl ether; ketones such as cyclohexanone, acetophenone, and isophorone; esters such as methyl benzoate, ethyl acetate; sulfur-containing compounds such as diphenylsulfide, fluoric compounds such as hexafluoroisopropanol; polar aprotic compounds such as N,N-dimethylformamide; mixtures of two or more of such compounds; and mixtures obtained by further adding alcohols acetonitrile or methyl ethyl ketone to one or more of such compounds.

While the thickness of the photosensitive layer is not particularly restricted, it is preferably from 5 to 100 μm and, more preferably, from 10 to 50 μm. In a case where the thickness is less than 5 μm, it is not preferred since the charge retainability on the surface of the electrophotographic photoreceptor may sometimes be deteriorated. In a case where the layer thickness exceeds 100 μm, it is not preferred since the productivity of the electrophotographic photoreceptor tends to be lowered.

(Charge Generating Layer and Charge Transporting Layer)

The photosensitive layer 2*a* is a laminate comprising a charge generating layer 3 and a charge transporting layer 4.

The charge generating layer 3 contains a charge generating substance and a binder resin.

As the charge generating substance, one or more of charge generating substances identical with those contained in the photosensitive layer 2 can be used.

As the binder resin, those used customarily as the matrix resin for the charge generating layer can be used and examples thereof include thermoplastic resins such as polyester, polystyrene, acrylic resin, methacrylic resin, polycarbonate (including the aromatic polycarbonate of the invention), and polyarylate; thermosetting resins such as polyurethane, phenolic resin, alkyd resin, melamine resin, epoxy resin, silicone resin, phenoxy resin, polyvinyl butyral, and polyvinyl formal; and copolymer resins containing two or more of the constituent units contained in the resins (insulating resins such as vinyl chloride-vinyl acetate copolymer resin, vinyl chloride-vinyl acetate-maleic acid anhydride copolymer resin, and acrylonitrile-styrene copolymer resin). Among them, polyvinyl butyral is preferred. The hinder resins can be used each alone or two or more of them can be used in combination.

While the content ratio of the charge generating substance and the binder resin is not particularly restricted, it is preferred that the charge generating substance is contained by from 10 to 99% by weight based on the entire amount for the total amount of the charge generating substance and the binder resin. In a case where the ratio of the charge generating substance is less than 10% by weight, this is not preferred since the sensitivity may possibly be lowered. In a case where the ratio of the charge generating substance exceeds 99%, this is not preferred since (1) the layer strength of the charge generating layer 3 is sometimes deteriorated, or (2) the dispersibility of the charge generating substance is lowered to sometimes increase coarse particles and decrease the surface charge for the portions other than those to be erased by exposure. Deterioration of the layer strength and the decrease of the surface charges results in a cause for frequent occurrence of image defects, particularly, image fogging referred to as black spots in which toner is deposited to the white background to form minute black spots.

The charge generating layer 3 may also contain optionally, in addition to two kinds of essential ingredients described above, one or more substances selected from hole transporting substance, electron transporting substance, antioxidant, dispersion stabilizer, and sensitizer each in an appropriate amount. This can improve the potential property, as well as improve the stability of the coating solution for forming the charge generating layer to be described later, mitigate fatigue deterioration of the electrophotographic photoreceptor during repetitive use thereby improving the durability.

The charge generating layer 3 can be formed, for example, by dissolving or dispersing a charge generating substance, a binder resin and, optionally, other additives into an appropriate organic solvent to prepare a coating solution for forming the charge generating layer, coating the coating solution on the surface of the conductive substrate 1 or the undercoat layer 6 to be described later, and drying to remove the organic solvent. Specifically, a coating solution for forming a charge generating layer is produced, for example, by dissolving or dispersing a charge generating substance, and, optionally, other additives in a resin solution obtained by dissolving the binder resin in an organic solvent.

Examples of the organic solvent include halogenated hydrocarbons such as tetrachloropropane, and dichloroethane; ketones such as isophorone, methylethylketone, acetophenone, and cyclohexanone; esters such as ethyl acetate, methyl enzoate, and butyl acetate; ethers such as tetrahydrofurane (THF), dioxane, dibenzyl ether, and 1,2-dimethoxyethane; aromatic hydrocarbons such as benzene, toluene, xylene, mesitylene, tetrahydronaphthalene, diphenyl methane, dimethoxybenzene, and dichlorobenzene; sulfur-containing solvent such as diphenyl sulfide; fluoric solvents such as hexafluoroisopropanol; and polar aprotic polar solvents such as N,N-dimethylformamide and N,N-dimethylacetoamide. Further, mixed solvent obtained by mixing two or more of such solvents can also be used.

Prior to dissolving or dispersing the charge generating substance, etc. into the resin solution, the charge generating substance and other additives may be pulverized previously. Previous pulverization is conducted, for example, by using a usual pulverizer such as a ball mill, a sand mill, an attriter, a vibration mill, or an ultrasonic dispersing machine.

Dissolution or dispersion of the charge generating substance or the like into the resin solution is conducted, for example, by using a usual dispersing device such as a paint shaker, a ball mill, or a sand mill. In this case, dispersing conditions are preferably selected properly so as not to form impurities due to wear or the like from members constituting a vessel for containing the resin solution, and the charge generating substance, and the dispersing machine and not intruded into the coating solution.

Examples of the coating method for the coating solution for forming the charge generating layer include roll coating, spray coating, blade coating, wring coating, dip coating, etc.

While the thickness of the charge generating layer 3 is not particularly restricted, it is, preferably, from 0.05 to 5 μm and, more preferably, from 0.1 to 1 μm. In a case where the thickness of the charge generating layer is less than 0.05 μm, it is not preferred since the efficiency of light absorption is lowered to sometimes lower the sensitivity. In a case where the thickness of the charge generating layer exceeds 5 μm, it is not preferred since the charge transfer in the inside of the charge generating layer constitutes a rate-determining step in the course of eliminating charges on the surface of the electrophotographic photoreceptor to sometimes lower the sensitivity.

The charge transporting layer 4 can be formed of an aromatic polycarbonate of the invention having a function of accepting electric charges generated in the charge generating substance and transporting them. Further, the charge transporting layer 4 can contain a charge transporting substance other than the aromatic polycarbonate of the inventions a binder resin other than the aromatic polycarbonate of the invention, and an antioxidant. The charge transporting layer 4 may also be constituted so as to contain a charge transporting substance other than the aromatic polycarbonate of the invention and a binder resin other than the aromatic polycarbonate of the invention as the essential ingredient and, optionally, an additive such as an antioxidant. The aromatic polycarbonate of the invention is preferably contained in the charge transporting layer 4 within a range from 50 to 75% by weight.

For the aromatic polycarbonate of the invention, one or more substances selected from homopolymers comprising the constituent unit (1) and copolymers containing the constituent unit (1) and the constituent unit (2) can be used.

Further, for the charge transporting substance other than the aromatic polycarbonate of the invention, the binder resin other than the aromatic polycarbonate of the invention, and the antioxidant, substances identical with those used in the photosensitive layer 2 can be used in the identical amount, respectively.

The charge transporting layer 4 can be produced, for example, by dissolving or dispersing an aromatic polycarbonate of the invention, optionally, a charge transporting substance other than the aromatic polycarbonate of the invention, a binder resin other than the aromatic polycarbonate of the invention, and an antioxidant into an appropriate organic solvent to prepare a coating solution for forming a charge transporting layer, coating the coating solution for forming the charge transporting layer on the surface of the charge generating layer 3, and drying the same to remove the organic solvent.

As the organic solvent used herein, those identical with the organic solvent used for forming the photosensitive layer 2 can be used. The method of coating the coating solution for forming a charge transporting layer on the surface of charge generating layer 3 is not particularly restricted and examples thereof include dip coating, roll coating, and ink jet coating. Further, drying may be conducted while properly selecting a temperature capable of removing the organic solvent contained in the coating solution and forming the charge transporting layer 4 having a uniform surface.

While the thickness of the charge transporting layer 4 is not particularly restricted, it is, preferably, in a range of from 5 to 50 μm and, more preferably, from 10 to 40 μm. In a case where the thickness of the charge transporting layer is less than 5 μm, it is not preferred since the charge retainability on the surface of the electrophotographic photoreceptor may possibly be lowered. In case where the thickness of the charge transporting layer exceeds 50 μm, this is not preferred since the resolution power of the electrophotographic photoreceptor may possibly be lowered.

(Surface Protection Layer)

The surface protection layer 5 has, for example, a function of improving the durability of the photosensitive layer 2, 2*a*. Surface protection layer 5 can be formed, for example, by coating a resin solution obtained by dissolving a binder resin (including the aromatic polycarbonate of the invention) into an appropriate solvent to the surface of the photosensitive layer 2, 2*a*, and drying the same to remove the organic solvent.

As the organic hinder resin and the organic solvent used herein, those used in the charge transporting layer 4 can be used in the identical amount. The aromatic polycarbonate of the invention is contained in the surface protection layer 5 preferably within a range of from 70 to 90% by weight.

While the thickness of the surface protection layer 5 is not particularly restricted, it is, preferably, in a range of from 0.5 to 10 μm and, more preferably, from 1 to 5 μm. In a case where the thickness of the surface protection layer 5 is less than 0.5 μm, it is not preferred since the friction resistance on the surface of the electrophotographic photoreceptor is deteriorated to sometimes make the durability insufficient. In a case where it exceeds 10 μm, it is not preferred since the resolution power of the electrophotographic photoreceptor is sometimes lowered.

(Undercoat Layer)

The undercoat layer 6 has a function of preventing infection of electric charges from the conductive substrate 1 to the photosensitive layer 2, 2*a*. As a result, this can prevent lowering of the chargeability of the photosensitive layer 2, 2*a*, can suppress the decrease of the surface charges in the portion other than the portion to be erased by exposure, and can present occurrence of image defects such as fogging. Particularly, this can prevent occurrence of image fogging referred to as black specks in which minute black spots comprising toner are formed on the white background upon image formation by a reversal developing process. Further, by coating the undercoat layer 6 to the surface of the conductive substrate 1, degree of unevenness as defects on the surface of the conductive substrate 1 can be decreased to planarize the surface. Accordingly, since the layer forming property of the photosensitive layer 2, 2*a* on the undercoat layer 6 can be improved, adhesion between the conductive substrate 1 and the photosensitive layer 2, 2*a* can be improved.

The undercoat layer 6 can be formed, for example, by preparing a coating solution for forming an undercoat layer obtained by dissolving a resin material into an appropriate solvent, coating the coating solution on the surface of the conductive substrate 1, and removing the solvent in the coating solution by heating. Examples of the resin material constituting the resin layer include thermoplastic resins such as polyethylene, polypropylene, polystyrene, acrylic resin, vinyl chloride resin, vinyl acetate resin, polyester, polycarbonate, polyester carbonate, polysulfone, polyvinyl butyral, polyamide, and polyarylate; thermosetting resins such as polyurethane, epoxy resin, melamine resin, phenoxy resin, and silicone resin; copolymer resins containing two or more of constituent units contained in the thermoplastic resins or the thermosetting resins; and natural polymeric materials such as casein, gelatin, polyvinyl alcohol, and ethyl cellulose. Examples of the solvent for dissolving or dispersing the resin material include water; alcohols such as methanol, ethanol, and butanol; glimes such as methyl carbitol, and butyl carbitol; and mixed solvents obtained by mixing two or more of such solvents.

Further, metal oxide particles may also be added to the coating solution for forming the undercoat layer. Addition of the metal oxide particles can easily control the volume resistivity of the undercoat layer 6, can further suppress injection of electric charges from the conductive substrate 1 to the photosensitive layer 2, 2*a*, and can maintain the electric property of the electrophotographic photoreceptor under various circumstances. Examples of the metal oxide particles include particles of titanium oxide, aluminum oxide, aluminum hydroxide, and tin oxide. The apparatus for dispersing the metal oxide particles into the coating solution for forming the undercoat layer include usual particle dispersion apparatus such as a ball mill, sand mill, attriter, vibration mill, and ultrasonic dispersing device.

In the coating solution for forming the undercoat layer containing the resin material and the metal oxide particles, assuming the content for the total of the resin material and the metal oxide particles as C and the content of the solvent as D, the ratio (C/D) between them is, preferably, in a range of from 1/99 to 40/60 (=0.01 to 0.67 weight ratio) and, more preferably, from 2/98 to 30/70 (=0.02 to 0.43 weight ratio). Further, the ratio (E/F) between the resin material content (E) and the metal oxide particle content (F) is, preferably, in a range of from 1/99 to 90/10 (=0.01 to 9.0 by weight ratio) and, more preferably, from 5/95 to 70/30 (=0.05 to 2.33 by weight ratio).

While the thickness of the undercoat layer 6 is not particularly restricted, it is preferably in a range of from 0.01 to 20 μm and, more preferably, from 0.1 to 10 μm. In a case where the thickness is less than 0.01 μm, the undercoat layer 6 no more functions substantially as such, cannot provide a uniform surface by coating the defects on the conductive substrate 1, and cannot sometimes prevent injection of electric charges from the conductive substrate 1 to the photosensitive layer 2, 2*a*. As a result, since the chargeability of the photosensitive layer 2, 2*a* is sometimes lowered, it is not preferred. In a case where the thickness exceeds 20 μm, it is not preferred since uniform formation of the undercoat layer 6 is difficult and the sensitivity of the electrophotographic photoreceptor is sometimes lowered. A layer containing alumite (alumite layer) may be formed on the surface of the conductive substrate 1 and the layer may be used as the undercoat layer 6.

[Image Forming Apparatus]

Figure 9:
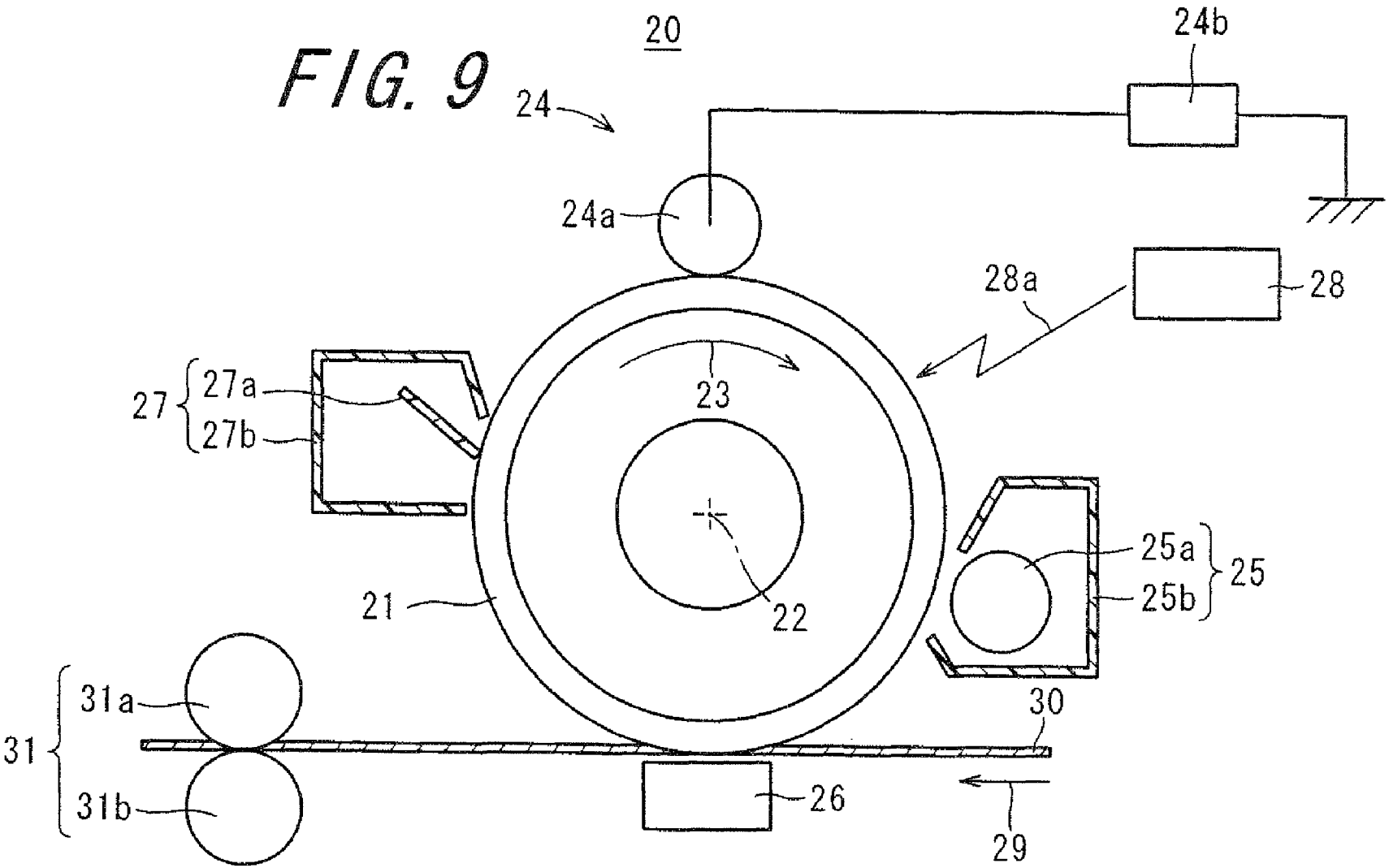
FIG. 9 is a side elevational view for the arrangement schematically showing the constitution of an image forming apparatus of the invention.

FIG. 9 is a side elevational view for the arrangement schematically showing the constitution of an image forming apparatus 20 as an embodiment of the invention. The image forming apparatus 20 has an electrophotographic photoreceptor 21 of the invention having any one of the constitutions shown in FIGS. 1 to 8 described previously. The image forming apparatus 20 as the embodiment of the invention is to be described with reference to FIG. 9. The image forming apparatus of the invention is not restricted to the contents of the following descriptions.

The image forming apparatus 20 includes an electrophotographic photoreceptor 21 supported rotationally on an apparatus main body (not shown), a charger 24, an exposure section 28, a developing device 25, a transfer device 26, a cleaner 27, and a fixing device 31.

The electrophotographic photoreceptor 21 is rotated by a driving mechanism (not shown) about a rotational axis 22 in the direction of an arrow 23. The driving mechanism includes, for example, an electric motor and a speed reduction gear. The driving mechanism transmits the driving force thereof to a conductive substrate constituting the core of the electrophotographic photoreceptor 21 thereby rotationally driving the electrophotographic photoreceptor 21 at a predetermined circumferential speed. The charging device 24, the exposure section 28, the developing device 25, the transfer device 26, and the cleaner 27 are disposed in this order along the outer peripheral surface of the electrophotographic photoreceptor 21 from the upstream to the downstream in the rotational direction of the electrophotographic photoreceptor 21 shown by the arrow 23.

The charging device 24 is a charging section for charging the outer peripheral surface of the electrophotographic photoreceptor 21 to a predetermined potential. The charging device 24 in FIG. 9 has a contact type charging roller 24*a* and a bias power source 24*b* for applying a voltage to the charging roller 24*a*. As the charging section, a charge wire can also be used. Particularly, in a case of the former charging roller, since a high friction resistance is required for the surface of the photoreceptor, an electrophotographic photoreceptor formed with a surface protection layer has a significant effect due to the improvement of the durability.

The exposure section 28 includes, for example, a semiconductor laser as a light source. The exposure section 28 can irradiate a portion of the electrophotographic photoreceptor 21 between the charging device 24 and the developing device 25, with light 28*a* such as a laser beam outputted from the light source. As a result, exposure can be applied in accordance with image information to the charged outer peripheral surface of the electrophotographic photoreceptor 21. The light 28*a* is usually scanned repetitively in the extending direction of the rotational axis 22 of the electrophotographic photoreceptor 21 as the main scanning direction and, correspondingly, electrostatic latent images are formed successively to the surface of the electrophotographic photoreceptor 21.

The developing device 25 is a developing section for developing static latent images formed on the surface of the electrophotographic photoreceptor 21 by a developer. The developing device 25 is disposed facing the electrophotographic photoreceptor 21 and has a developing roller 25*a* for supplying a toner to the outer peripheral surface of the electrophotographic photoreceptor 21 and a casing 25*b*. The casing 25*b* supports the developing roller 25*a* rotationally around the rotational axis in parallel with the rotational axis 22 of the electrophotographic photoreceptor 21 and contains a toner-containing developer in the space at the inside thereof.

The transfer device 26 is a transfer section for transferring toner images formed as visible images by development on the outer peripheral surface of the electrophotographic photoreceptor 21 to a sheet to which toner images are to be transferred 30 which is a recording medium supplied between the electrophotographic photoreceptor 21 and the transfer device 26 by a transporting section (not shown) in the direction of an arrow 29. The transfer device 26 is, for example, a non-contact type transfer section having a charging portion and transferring toner images to the sheet 30 by applying electric charges of a polarity opposite to that of the toner to the sheet 30.

The cleaner 27 is a cleaning section for removing and recovering a toner remaining on the outer peripheral surface of the electrophotographic photoreceptor 21 after the transferring operation by the transfer device 26. The cleaner 27 has a cleaning blade 27*a* for peeling the toner remaining on the outer peripheral surface of the electrophotographic photoreceptor 21, and a recovering casing 27*b* for containing the toner peeled by the cleaning blade 27*a*. Further, the cleaner 27 may be disposed together with a charge elimination lamp (not shown).

Further, in the image forming apparatus 20, a fixing device 31 as a fixing section for fixing the transferred image may also be disposed on the downstream side where the sheet 30 after passing between the electrophotographic photoreceptor 21 and the transfer device 26 is transported. The fixing device 31 has a heating roller 31*a* having a heating section (not shown) and a pressure roller 31*b* disposed to be opposed to the heating roller 31*a* and pressed against the heating roller 31*a* to form a nip portion.

The image forming operation by the image forming apparatus 20 is conducted as described below. At first, when the electrophotographic photoreceptor 21 is rotationally driven by the driving mechanism in the direction of the arrow 23, the surface of the electrophotographic photoreceptor 21 is uniformly charged at a predetermined positive or negative potential by the charging device 24 which is disposed on the upstream side in the rotational direction of the electrophotographic photoreceptor 21 relative to the focusing point of the light 28*a* by the exposure section 28.

Then, the light 28*a* in accordance with the image information is emitted from the exposure section 28 on the surface of the electrophotographic photoreceptor 21. The surface charges of the electrophotographic photoreceptor 21 at a portion irradiated with the light 28*a* is eliminated by the exposure, in which difference is caused between the surface potential at the portion irradiated with the light 28*a* and the surface potential not irradiated with the light 28*a* to form electrostatic latent images.

A toner is supplied from the developing device 25 disposed on the downstream side in the rotational direction of the electrophotographic photoreceptor 21 relative to the focusing point of the light 28*a* by the exposure section 28, onto the surface of the electrophotographic photoreceptor 21 where the electrostatic latent images are formed, and the electrostatic latent images are developed to form toner images.

In synchronization with exposure to the electrophotographic photoreceptor 21, the sheet 30 is supplied between the electrophotographic photoreceptor 21 and the transfer device 26. Electric charges of a polarity opposite to that of the toner are given to the sheet 30 supplied by the transfer device 26, and the toner images formed on the surface of the electrophotographic photoreceptor 21 are transferred to the sheet 30.

The sheet 30 to which the toner images have been transferred is transported by the transporting section to the fixing device 31 and heated and pressed upon passage through the nip portion between the heating roller 31*a* and the pressure roller 31*b* of the fixing device 31, and toner images are fixed to the sheet 30 to form fastened images. The sheet 30 formed with the images as described above is discharged by the transporting section to the outside of the image forming apparatus 20.

On the other hand, the toner still remaining on the surface of the electrophotographic photoreceptor 21 even after the transfer of the toner images by the transfer device 26 is peeled from the surface of the electrophotographic photoreceptor 21 and recovered by the cleaner 27. The electric charges on the surface of the electrophotographic photoreceptor 21 from which the toner has been removed as described above are eliminated by light from the charge elimination lamp, and electrostatic latent images on the surface of the electrophotographic photoreceptor 21 disappear. Then, the electrophotographic photoreceptor 21 is further driven rotationally, and then a series of operations starting from the charging are repeated again to form images continuously.

Since the image forming apparatus of the invention has an electrophotographic photoreceptor having an appropriate conductivity and excellent in the durability, it can form images at high quality under various circumstances.

EXAMPLE

The invention is to be described more specifically with reference to production examples, examples, and comparative examples but the invention is not restricted to the contents of the following descriptions. "Parts" mean hereinafter often "parts by weight".

Production Example

Production of Exemplified Compound No. 1

A synthetic scheme for Exemplified Compound No. 1 of using benzophenone (13aa) as a ketone compound (13a) and using 1-phenyl-1-naphthyl hydrazine (13bb) as a hydrazine compound (13b), subjecting them to dehydrating condensation reaction to obtain a hydrazone compound (9aa) is shown.

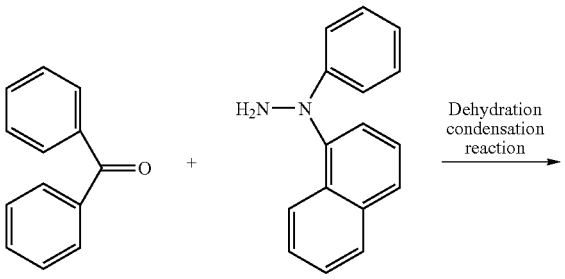

(13aa) (13bb)

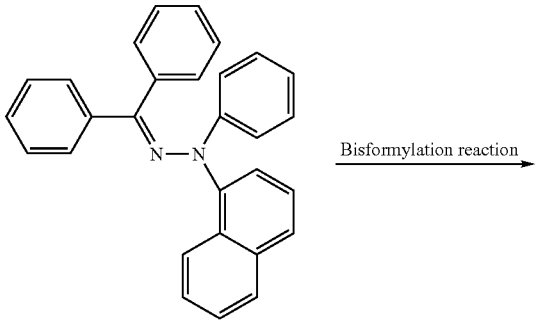

(9aa)

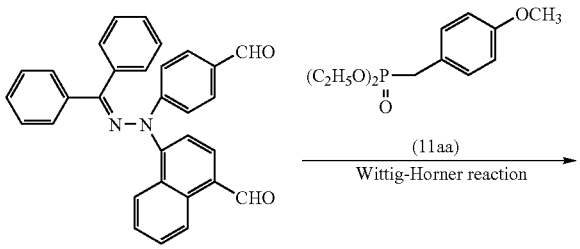

(10aa)

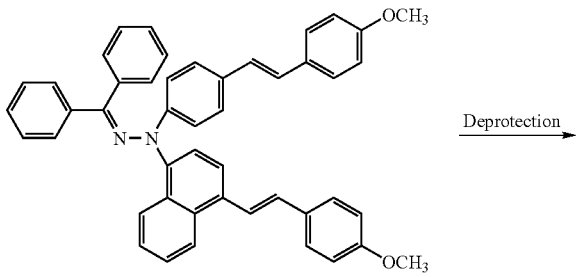

(12aa)

-continued

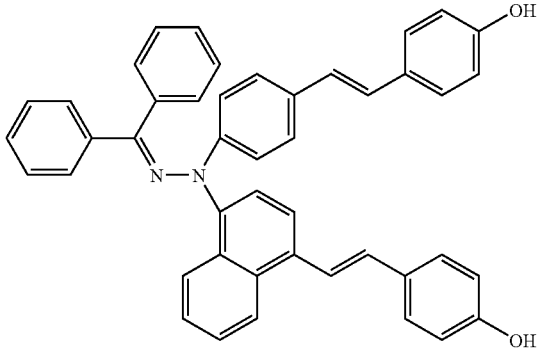

(6aa)

<Production of Hydrazone Compound (9aa)>

In 100 mL of ethanol, 18.2 g of (1.0 molar equivalent) of benzophenone (13aa), 24.6 g (1.05 molar equivalent) of 1-naphthyl-1-phenylhydrazine (13bb), and 0.06 mL (0.01 molar equivalent) of acetic acid as a catalyst were added and reacted by stirring while heating at 80° C. for 6 hrs. After allowing the reaction solution to cool, 1000 mL of hexane was added, and precipitated crystals were collected by filtration, and dried under a reduced pressure to obtain 35.8 g of a hydrazone compound (9aa) as yellow crystals (yield: 90.0%)

<Production of Hydrazone-Aldehyde Compound (10aa)>

Then, in 100 mL of anhydrous N,N-dimethylformamide (DMF), 16.86 g (2.2 molar equivalent) of phosphorous oxychloride was gradually added, and stirred for about 30 mins to prepare a Vilsmeier reagent. In the solution, 19.92 g (1.0 molar equivalent) of the hydrazone compound (9aa) obtained as described above was gradually added. Then, the temperature of the reaction solution was elevated to 80° C. by gradual heating, and reaction was conducted by stirring for 6 hrs while heating so as to keep the temperature at 80 to 90° C. After the completion of the reaction, the reaction solution was allowed to cool and it was gradually added to 800 mL of a cooled aqueous solution of 4N sodium hydroxide, to form precipitation. After collecting the resultant precipitates by filtration and sufficiently washing with water, they were recrystallized by a mixed solvent of ethanol and ethyl acetate to obtain 18.4 g of a yellow powdery compound.

As a result of analyzing the obtained yellow powdery compound by liquid chromatography-mass spectrometry (LC-MS), a peak corresponding to a molecule ion $[M+H]^+$ in which a proton was added to the hydrazone-bisaldehyde compound (10aa) (theoretical value of the molecular weight: 454.17) was observed at 455.6. It was confirmed therefrom that the obtained compound was a hydrazone-bisaldehyde compound represented by the structural formula (10aa) (yield: 81%). Further, from the result of the LC-MS analysis, the purity of the obtained hydrazone-aldehyde compound (10aa) was 99.0%.

<Production of Asymmetric Bisalkoxyhydrazone Compound (12aa)>

7.26 g (1.0 molar equivalent) of a hydrazone-bisaldehyde compound (10aa) and 14.571 g (2.4 molar equivalent) of diethyl-p-methoxybenzylphosphonate (11aa) were dissolved in 80 ml of anhydrous DMF, and 5.6 g (2.5 molar equivalent) of potassium t-butoxide was gradually added to the solution under stirring at 0° C. Then, they were left at a room temperature for 1 hr and then heated to 50° C. and stirred for 5 hrs while heating so as to keep the temperature at 50° C. After allowing to cool the reaction mixture, it was poured into excess methanol. Precipitates were recovered and dissolved in toluene to form a toluene solution. After transferring the toluene solution into a separating funnel and washing with water, the separated organic layer was dried with magnesium sulfate. After drying, solids were removed and the organic layer was concentrated under a reduced pressure and subjected to silica gel column chromatography to obtain 9.0 g of yellow crystals.

As a result of LC-MS analysis for the obtained yellow crystals, a peak corresponding to the molecule ion $[M+H]^+$ in which a proton was added to the compound represented by the chemical formula (12aa) (theoretical value of molecular weight: 662.83) was observed at 663.91. It was found therefrom that the crystals were an asymmetric bisalkoxyhydrazone compound (12aa) as a precursor for the Exemplified Compound No. 1 (yield: 85%). Further, based on the result of HPLC analysis upon LC-SM measurement, the purity of the obtained compound was 97.7%.

<Synthesis of Asymmetric Bishydroxy Compound (6aa) (Exemplified Compound No. 1)>

6.58 g (1.0 molar equivalent) of an asymmetric bisalkoxy hydrazone compound (12aa) and 6.39 g (7.0 molar equivalent) of a sodium ethanethiol salt were suspended in 130 ml of N,N-dimethylformamide and when they were heated gradually while stirring under a nitrogen gas stream, bubbling started at 130° C. After the bubbling was subsided, they were refluxed under heating for 4 hrs while further elevating the temperature. The reaction mixture was allowed to cool to a room temperature and poured into 600 ml of iced water, to which 3.2 ml of a concentrated hydrochloric acid was added under stirring to conduct neutralization. They were extracted with 400 ml of ethyl acetate, the liquid extract was washed with water, dried with anhydrous magnesium sulfate, and filtered and then the solvent was distilled off under a reduced pressure to obtain 6.71 g of crude crystals. They were recrystallized from a mixed solvent of ethanol and ethyl acetate (ethanol:ethyl acetate=8:2 to 7:3), to obtain 5.55 g of a yellow powdery compound.

The elemental analysis values by a simultaneous determination for carbon(C), hydrogen(H), nitrogen(N), and oxygen (O) by the differential thermal conductivity method for the yellow powdery compound were as described below.

(Elemental Analysis Value for Exemplified Compound No. 1)

Theoretical value: C, 85.15%; H, 5.40%; N, 4.41%; O, 5.04%.

Measured value: C, 85.00%; H, 5.31%; N, 4.38%; O; 5.02%.

Further, as a result of LC-MS analysis for the obtained yellow powdery compound, a peak corresponding to a molecule ion $(M+H]^+$ in which a proton was added to a compound represented by an aimed chemical structural formula (6aa) (calculation value for the molecular weight: 634.78) was observed at 635.89.

As a result of the elemental analysis and the LC-MS analysis, it was found that the obtained yellow powdery compound was the asymmetric bishydroxyhydrazone compound (6aa) of the Exemplified Compound No. 1 (yield: 88%). Further, as a result of the HPLC analysis upon LC-MS measurement, the purity of the obtained compound (6aa) was 99.0%.

Production Example 2

Production of Exemplified Compound No. 6

Exemplified Compound No. 6 was produced by procedures quite identical with those in Production Example 1 except for using each of the starting compounds shown in the following Table 2 instead of the ketone compound (13aa), the hydrazine compound (13bb) and the Witting reagent (11aa) in Production Example 1. Table 8 also shows the starting compound for Exemplified Compound No. 1.

TABLE 8

| Compound | General formula (13aa) | General formula (13bb) | General formula (11aa) |
|---|---|---|---|
| Production Example 1<br>Exemplified Compound No. 1 | 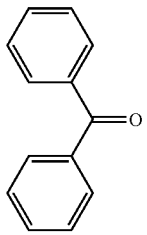 | 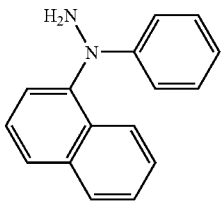 | 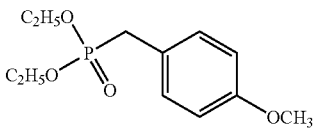 |
| Production Example 2<br>Exemplified Compound No. 6 | 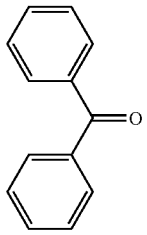 | 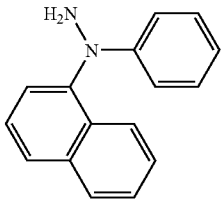 | 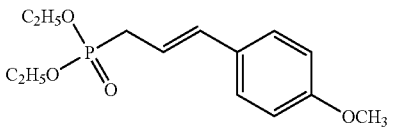 |

TABLE 8-continued

| Compound | General formula (13aa) | General formula (13bb) | General formula (11aa) |
|---|---|---|---|
| Production Example 3 Exemplified Compound No. 10 | 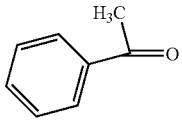 | 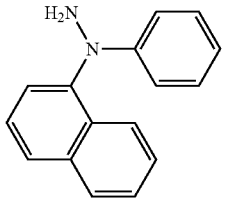 | 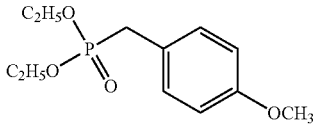 |

Production Example 3

Production of Exemplified Compound No. 10

Exemplified Compound No. 10 was produced by the procedures quite identical with those in Production Example 1 except for using each of the starting compounds shown in the following Table 2 instead of the ketone compound (13aa), the hydrazine compound (13bb) and the Wittig reagent (11aa) in the Production Example 1.

Table 9 shows structures and the result of the elemental analysis and the result of LC-MS for the asymmetric bishydroxy compounds obtained in Production Examples 1 to 3.

TABLE 9

| Compound | | C (%) | H (%) | N (%) | O (%) | LC-MS |
|---|---|---|---|---|---|---|
| Production Example 1 Exemplified Compound No. 1 | 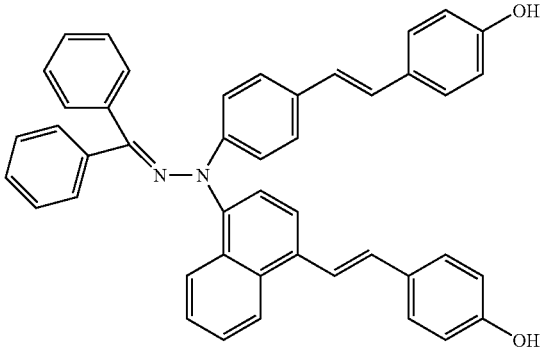 | Theoretical value 85.15 | 5.4 | 4.41 | 5.04 | Calculated value 662.83 |
| | | Measured value 84.9 | 5.31 | 4.38 | 5.02 | Measured value [M + H]+ 663.91 |
| Production Example 2 Exemplified Compound No. 6 | 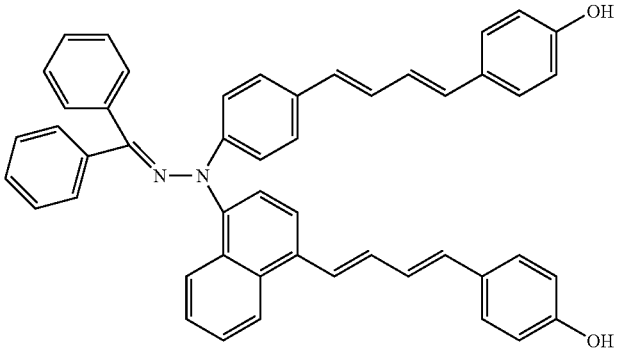 | Theoretical value 85.69 | 5.58 | 4.08 | 4.66 | Calculated value 686.85 |
| | | Measured value 85.59 | 5.54 | 4.02 | 4.61 | Measured value [M + H]+ 687.93 |
| Production Example 3 Exemplified Compound No. 10 | 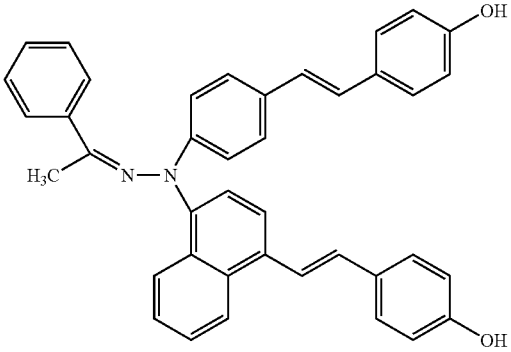 | Theoretical value 83.89 | 5.63 | 4.89 | 5.59 | Calculated value 672.7 |
| | | Measured value 83.77 | 5.59 | 4.83 | 5.52 | Measured value [M + H]+ 573.82 |

Production Example 4

Synthesis of Comparative Symmetric Bishydroxy Enamine Compound 4.21 g of a symmetric bishydroxy enamine compound represented by the following chemical structural formula (15) as the exemplified compound (EA-14) described in Example 1 of JP-A 2004-269377 (hereinafter often referred to as "symmetric bishydroxy enamine compound (15)" was obtained in the same manner as in Production Example 1 except for using 16.9 g (1.0 molar equivalent) of an enamine compound synthesized from diphenylamine and diphenyl acetoaldehyde as an amine compound instead of the hydrazine compound in Production Example 1.

(15)

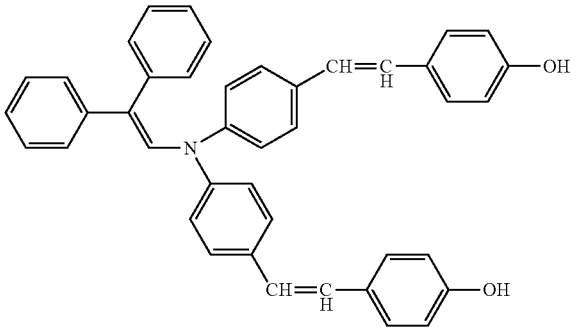

The elemental analysis values of the obtained symmetric bishydroxy enamine compound (15) were as described below.

<Elemental Analysis Values for Symmetric Bishydroxy Enamine Compound (15)>

Calculated value: C, 86.42%; H, 5.70%; N, 2.40%.

Measured value: C, 85.97%; H, 5.38%; N, 2.27%.

Further, as a result of the LC-MS analysis for the obtained symmetric bishydro enamine compound (15), a peak corresponding to a molecule ion $(M+H)^+$ in which a proton was added to a compound represented by an aimed chemical structural formula (15) (calculated value for the molecular weight: 583.73) was observed at 584.9.

As a result of the elemental analysis and the LC-MS analysis, it was confirmed that the obtained compound was a symmetric bishydroxy enamine compound of the exemplified compound (EA-14) described in JP-A 2004-269377 (yield: 83%). Further, as a result of the HPLC analysis upon LC-MS measurement, the purity of the obtained compound (15) was 98.3%.

Production Example 5

Synthesis of Aromatic Polycarbonate (P-1)

In an aqueous solution in which 1.62 g of sodium hydroxide and 0.075 g of sodium hydrosulfite were dissolved in 60 ml of water, 3.17 g of (5.0 mmol) of the asymmetric bishydroxy compound (6a) (Exemplified Compound No. 1) obtained in Production Example 1, 1.48 g (6.5 mmol) of 4,4'-1-methylethylidene)bisphenol, and 0.030 g of 4-tert-butylphenol were added and stirred under an argon gas stream. 40 ml of a dichloromethane solution of 2.11 g of triphosgene was gradually dropped under ice cooling and violent stirring to the mixed solution and reaction was conducted while forming an emulsion. After the completion of the dropping, the temperature of the reaction solution was lowered to a room temperature, to which 0.25 g of sodium hydroxide was added and 0.45 ml of triethylamine was further added. Then, the reaction was conducted while keeping the liquid temperature within a range from 25 to 30° C. for 3 hrs. After the completion of the reaction, 200 ml of dichloromethane was added to extract an organic layer. After washing the organic layer with an aqueous 3% solution of sodium hydroxide, an aqueous 2% hydrochloric solution, and ion exchanged water successively, it was re-precipitated in methanol to obtain 3.82 g of an aromatic polycarbonate (P-1) comprising the constituent unit (1) (corresponding to the general formula (1)) and the constituent unit (2) (corresponding to the general formula (2)) shown in Table 10.

When the molecular weight of the aromatic polycarbonate was measured by gel permeation chromatography, the number average molecular weight was 28,550 and the weight average molecular weight was 73,900 (each calculated based on polystyrene). Further, absorption attributable to C=O stretching vibration of the carbonate was observed at 1775 $cm^{-1}$ in the infrared absorption spectrum thereof. Further, based on the area ratio of signals by the $^1$H-NMR measurement, it was found that the structural unit (2) derived from Exemplified Compound No. 1 shown in Table 10 and the structural unit (1) derived from 4,4'-(1-methylethylidene) bisphenol were polymerized at a ratio of 0.34/0.66 (molar ratio).

Production Example 6

Synthesis of Aromatic Polycarbonate (P-2)

4.31 g of an aromatic polycarbonate (P-2) comprising the constituent unit (1) shown in Table 10 and the constituent unit (2) was obtained in the same manner as in Production Example 4 except for using 1.98 g (6.5 mmol) of 4,4'-cyclohexylidene bisphenol instead of 148 g (6.5 mmol) of 4,4'-(1-methylethylidene)bisphenol as the bisphenol ingredient.

When the molecular weight of the aromatic polycarbonate was measured by gel permeation chromatography, the number average molecular weight was 29,700 and the weight average molecular weight was 73,800 (each calculated based on polystyrene). Further, absorption attributable to C=O stretching vibration of the carbonate was observed at 1775 $cm^{-1}$ in the infrared absorption spectrum thereof. Further, based on the area ratio of signals by the $^1$H-NMR measurement, it was found that the structural unit (2) derived from the Exemplified Compound No. 1 shown in Table 10 and the structural unit (1) derived from 4,4'-cyclohexylidene bisphenol were polymerized at a ratio of 0.35/0.65 (molar ratio).

Production Example 7

Synthesis of Aromatic Polycarbonate (P-3)

4.08 g of an aromatic polycarbonate (P-3) comprising the constituent unit (1) shown in Table 10 and the constituent unit (2) was obtained in the same manner as in Production Example 4 except for using 3.43 g (5.0 mmol) of the exemplified compound No. 6 described in Table 1 instead of 3.17 g (5.0 mmol) of asymmetric bishydroxy compound (6a) (Exemplified Compound No. 1).

When the molecular weight of the aromatic polycarbonate was measured by gel permeation chromatography, the number average molecular weight was 26,000 and the weight average molecular weight was 68,900 (each calculated based on polystyrene). Further, absorption attributable to C=O stretching vibration of the carbonate was observed at 1775 $cm^{-1}$ in the infrared absorption spectrum thereof. Further, based on the area ratio of signals by the $^1$H-NMR measurement, it was found that the structural unit (2) derived from Exemplified Compound No. 6 shown in Table 1 and the structural unit (1) derived from 4,4'-cyclohexylidene bisphenol were polymerized at a ratio of 0.43/0.57 (molar ratio).

Production Example 8

Synthesis of Aromatic Polycarbonate (P-4)

3.82 g of an aromatic polycarbonate (P-4) comprising the constituent unit (1) shown in Table 10 and the constituent unit (2) was obtained in the same manner as in Production Example 4 except for using 2.86 g (5.0 mmol) of Exemplified Compound No. 10 described in Table 2 instead of 3.17 g (5.0 mmol) of the asymmetric bishydroxy compound (6a) (Exemplified Compound No. 1), and using 1.98 g (6.5 mmol) of 4,4'-cyclohexylidene bisphenol instead of 1.48 g (6.5 mmol) of 4,4-(1-methylethylidene) bisphenol as the bisphenol ingredient.

When the molecular weight of the aromatic polycarbonate was measured by gel permeation chromatography, the number average molecular weight was 28,800 and the weight average molecular weight was 72,500 (each calculated based on polystyrene). Further, absorption attributable to C=O stretching vibration of the carbonate was observed at 1775 $cm^{-1}$ in the infrared absorption spectrum thereof. Further, based on the area ratio of signals by the $^1$H-NMR measurement, it was found that the structural unit (2) derived from the Exemplified Compound No. 1 shown in Table 10 and the structural unit (1) derived from 4,4'-cyclohexylidene bisphenol were polymerized at a ratio of 0.36/0.64 (molar ratio).

Production Example 9

Synthesis of Comparative Aromatic Polycarbonate (P-5)

Reaction was conducted in the same manner as in Production Example 8 except for using 2.92 g (5.0 mmol) of Comparative Symmetric Bishydroxy Enamine Compound (14) synthesized in Production Example 4 instead of 3.17 g (5.0 mmol) of the asymmetric bishydroxy compound (6a) (Exemplified Compound No. 1), to obtain 3.84 g of an aromatic polycarbonate (P-5) comprising the constituent unit (1) shown in Table 10 derived from the symmetric bishydroxy enamine compound (14) and the constituent unit (2).

When the molecular weight of the aromatic polycarbonate was measured by gel permeation chromatography, the number average molecular weight was 28,000 and the weight average molecular weight was 71,000 (each calculated based on polystyrene). Further, absorption attributable to C=O stretching vibration of the carbonate was observed at 1775 $cm^{-1}$ in the infrared absorption spectrum thereof. Further, based on the area ratio of signals by the $^1$H-NMR measurement, it was found that the structural unit (1') derived from the symmetric bishydroxy enamine compound (15) and 4,4'-(1-methylethylidene) bisphenol were polymerized at 0.39/0.61 (molar ratio).

TABLE 10

| Production Example | Constituent unit (1) | Constituent unit 2 |
|---|---|---|
| 5 (P-1) | 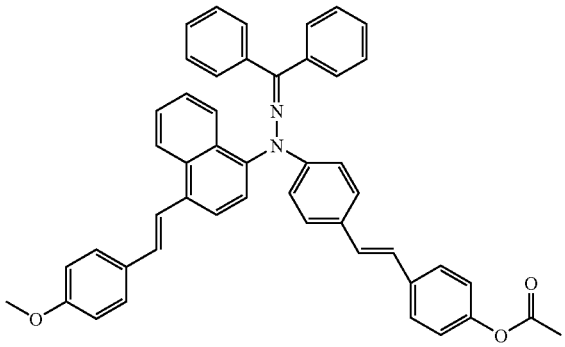 | 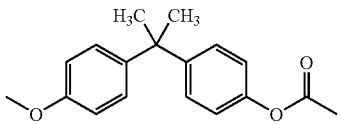 |
| 6 (P-2) | 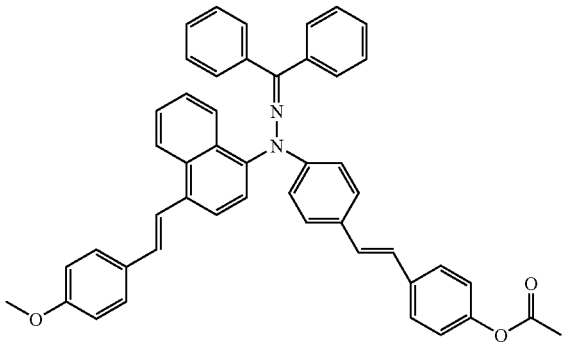 | 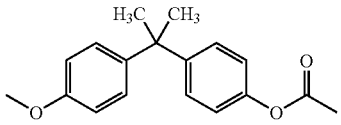 |

TABLE 10-continued

| Production Example | Constituent unit (1) | Constituent unit 2 |
|---|---|---|
| 7 (P-3) | 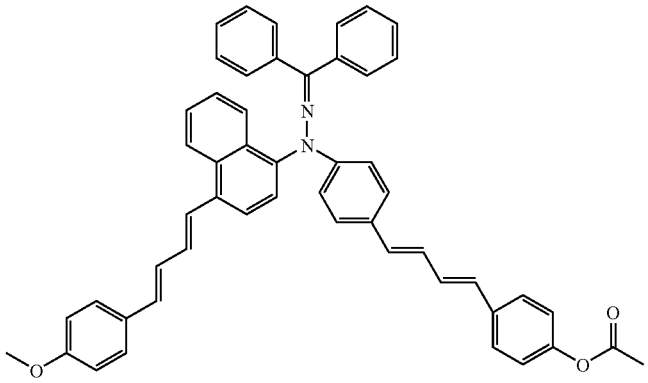 | 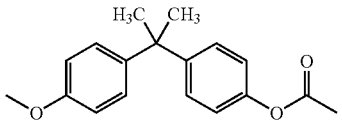 |
| 8 (P-4) | 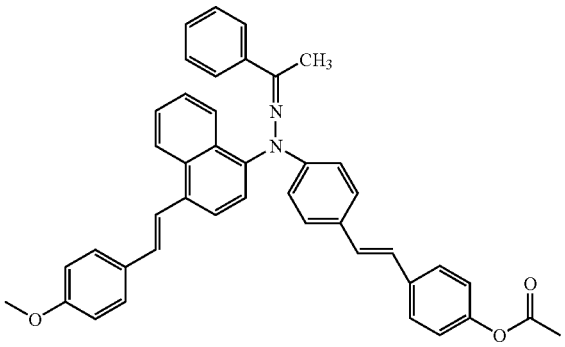 | 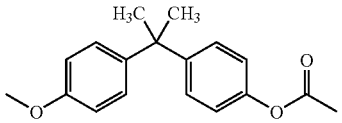 |
| 9 (P-5) | 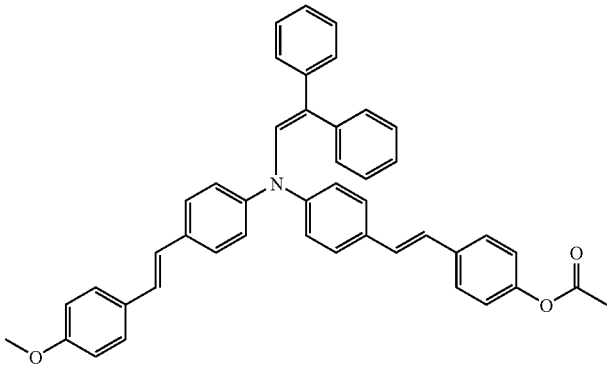 | 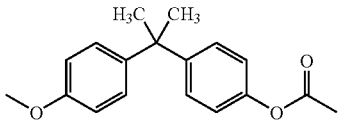 |

Example 1

7 parts of titanium oxide (TTO 55A; trade name of products manufactured by Ishihara Sangyo Kaisha, Ltd.) and 13 parts of a copolymer nylon resin (CM 8000; trade name of products manufactured by Toray Co.) were added to a mixed solvent comprising 159 parts of methyl alcohol and 106 parts of 1,3-dioxolane, and applied with a dispersing treatment by a paint shaker for 8 hrs to prepare a coating solution for forming an undercoat layer. The coating solution for forming the undercoat layer was filled into a coating tank, in which a drum-shaped substrate made of aluminum (conductive substrate) of 30 mm in diameter and 340 mm in length was dipped, and then pulled up and dried naturally to form an undercoat layer of 1 μm in thickness.

Then, one part of titanyl phthalocyanine having an X-ray diffraction spectrum in which a Bragg angle (2θ±0.2°) to X-ray of CuKα 1.541 Å show a main peak at 27.3°, and one part of a butyral resin (# 6000-C, trade name of products manufactured by Denki Kagaku Kogyo K.K.) were mixed to 98 parts of methylethylketone and applied with a dispersing treatment by a paint shaker to prepare a coating solution for forming a charge generating layer. The coating solution for forming the charge generating layer was applied in the same manner as in the case of forming the undercoat layer to the surface of the undercoat layer, and dried naturally to form a charge generating layer of 0.4 μm in thickness.

Then, 21 wt % tetrahydrofuran solution of the aromatic polycarbonate (P-1) produced in Production Example 5 was produced to form a coating solution for forming a charge transporting layer. The coating solution for forming the charge transporting layer was applied in the same manner as in the case of the undercoat layer to the surface of the charge generating layer, and dried at 110° C. for 1 hr to prepare a charge transporting layer of 21 μm in thickness, and a layered type electrophotographic photoreceptor having a lamination structure shown in FIG. 6 was manufactured.

Example 2

A layered type electrophotographic photoreceptor was manufactured in the same manner as in Example 1 except using an aromatic polycarbonate (P-2) produced in Production Example 6 instead of the aromatic polycarbonate (P-1).

Example 3

A layered type electrophotographic photoreceptor was manufactured in the same manner as in Example 1 except for using an aromatic polycarbonate (P-3) produced in Production Example 7 instead of the aromatic polycarbonate (P-1).

Example 4

A layered type electrophotographic photoreceptor was manufactured in the same manner as in Example 1 except for using an aromatic polycarbonate (P-4) produced in Production Example 8 instead of the aromatic polycarbonate (P-1).

Example 5

An undercoat layer of 1 μm in thickness and a charge generating layer of 0.4 μm in thickness were formed successively in the same manner as Example 1 to the surface of a drum-shaped substrate made of aluminum of 30 mm in diameter and 340 mm in entire length.

Then, 100 parts of (1,1-bis(p-diethylaminophenyl)-4,4-diphenyl-1,3-butadiene, (T 405; trade name of products manufactured by Takasago Chemical Co.) as a butadiene compound represented by the following general formula (16), 100 parts of Z-type polycarbonate comprising the structural unit represented by the following general formula (17) (Iupilon Z-400; manufactured by Mitsubishi Gas Chemical Co.), and 5 parts of 2,6-bis-tert-butyl-4-methylphenol (Sumilizer BHT; trade name of products manufactured by Sumitomo Chemical Co.) were mixed to prepare a coating solution for forming a charge transporting layer of 21 wt % solid content using tetrahydrofuran as a solvent. After applying the coating solution for the charge transporting layer in the same manner as in the intermediate layer described above to the charge generating layer disposed previously, it was dried at 110° C. for 1 hr to form a charge transporting layer of 21 μm in thickness.

(16)

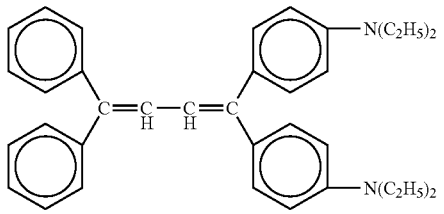

(17)

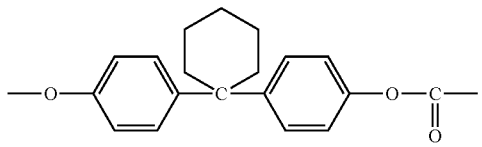

Then, 21 wt % tetrahydrofuran solution of the aromatic polycarbonate (P-3) produced in Production Example 7 was produced to form a coating solution for forming a surface protection layer. The coating solution for forming the surface protection layer was applied in the same method as in the case of forming the undercoat layer in Example 1 to the surface of the charge transporting layer, dried at 110° C. for 1 hr and a surface protection layer of 4 μm in thickness was formed to manufacture a layered type electrophotographic photoreceptor having the lamination structure in FIG. 8.

Comparative Example 1

A layered type electrophotographic photoreceptor was manufactured in the same manner as Example 5 except for not providing the surface protection layer.

Comparative Example 2

An undercoat layer of 1 μm in thickness, a charge generating layer of 0.4 μm in thickness, and a charge transporting layer of 21 μm in thickness were formed successively in the same manner as in Example 1 on the surface of a drum-shaped substrate made of aluminum of 30 mm in diameter and 340 mm in entire length.

Then, 10 wt % tetrahydrofuran solution of the Z-type polycarbonate (Iupilon Z 800; trade name of products manufactured by Mitsubishi Gas Chemical Co.) was produced to form a coating solution for forming a surface protection layer. The coating solution for forming the surface protection layer was applied in the same method as in the case of forming the undercoat layer in Example 1 to the surface of the charge transporting layer, dried at 110° C. for 1 hr and a surface protection layer of 4 μm in thickness was formed to manufacture a layered type electrophotographic photoreceptor having the multi-layered structure in FIG. 8.

Comparative Example 3

In the same manner as in Example 1, a layered type electrophotographic photoreceptor was manufactured except for using the aromatic polycarbonate (P-5) produced in Production Example 9 instead of the aromatic polycarbonate (P-1) upon forming the charge transporting layer.

(Image Evaluation)

The layered type electrophotographic photoreceptors obtained in Examples 1 to 5 and Comparative Examples 1 to 3 were mounted on a commercial copying machine (AR-451N; trade name of products manufactured by Sharp Corp.), half tone images were checked, and states of images at the initial state and after 100,000 copies were evaluated.

Further, at the initial state and after 100,000 copies, a developer tank was taken out of a developing device of the copying machine for evaluation and, instead, a surface potential meter (Model 344; trade name of products manufactured by Trek Co.) was set, and the surface potential V0(V) upon reproduction of white solid originals, a surface potential VH(V) upon reproduction of half tone originals and a surface potential VL(V) upon copying of black solid originals were measured to evaluate the electric property.

(Durability Evaluation)

The layered type electrophotographic photoreceptors obtained in Examples 1 to 5 and Comparative Examples 1 to 3 were mounted to a commercial copying machine (AR 451N; trade name of products manufactured by Sharp Corp.) and 10,000 image copies were conducted. Total layer thicknesses T1 and T2 on a drum substrate in an electrophotographic photoreceptor before copying of images and after copying of images were measured by a layer thickness measurement instrument (MCPD 1100: trade name of products manufactured by Otsuka Electronics Co., Ltd.) to determine the wear amount ΔT (=T1−T2). It was evaluated that the durability was inferior as the wear amount was larger. The results are shown in Table 11.

TABLE 11

| | | Initial state | | | After 100,000 copies | | | |
|---|---|---|---|---|---|---|---|---|
| | | VO (V) | VL (V) | Image state | VO (V) | VL (V) | Image state | Wear amount |
| Example | 1 | −650 | −73 | Good | −630 | −77 | Good | 4.1 |
| | 2 | −650 | −80 | Good | −620 | 84 | Good | 4.2 |
| | 3 | −650 | −74 | Good | −625 | −77 | Good | 4.2 |
| | 4 | −650 | −84 | Good | −635 | −88 | Good | 4.8 |
| | 5 | −650 | −88 | Good | −630 | −95 | Good | 4.9 |
| Comparative | 1 | −650 | −80 | Good | −510 | −83 | Fogging occurred | 8 |
| Example | 2 | −650 | −350 | Light | — | — | Image not formed | 3.4 |
| | 3 | −650 | −76 | Black spot formed | −625 | −95 | Black spot increased | 4.5 |

In Examples 1 to 4 using the aromatic polycarbonate of invention for the charge transporting layer and Example 5 using the same for the surface protection layer, the state of images was satisfactory even after repetitive use (100,000 copies), and wear was small.

On the contrary, in Comparative Example 1, although the state of images was satisfactory in the initial stage, fogging occurred in the images after the repetitive use. Further, the wear was large and lowering of the chargeability was remarkable.

In Comparative Example 2, although the chargeability at the initial stage was good, since the potential was not decayed by exposure, the image density was low and the state of image was light. Further, after repetitive use, images were scarcely formed. This is considered to be attributable to that the surface protection layer had no charge transport capability and could not eliminate electric charges even when they were charged.

In Comparative Example 3, black spots were formed. This is considered that while known aromatic polycarbonate was used for the charge transporting layer, since the constituent unit (1) of the aromatic polycarbonate had a high symmetricity in view of the chemical structure, the solubility was low, a portion insoluble to the solvent remained in the crystallized state in the charge transporting layer and the portion appears as black spots in the images.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic photoreceptor comprising:

a conductive substrate; and a photosensitive layer containing an aromatic polycarbonate on the conductive substrate, wherein the aromatic polycarbonate comprises a constituent unit represented by the following general formula (1):

(1)

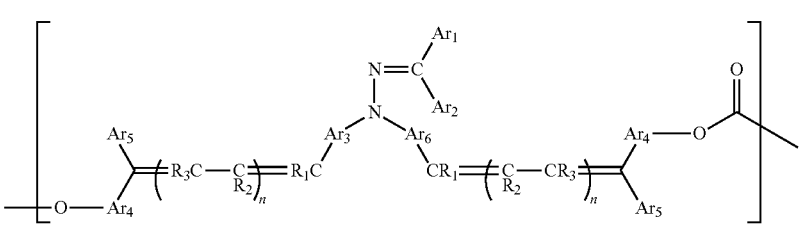

where $Ar_1$ and $Ar_2$ are identical with or different from each other and each represent an aryl group which may have a substituent or a heterocyclic group which may have a substituent, $Ar_3$ represents an arylene group which may have a substituent or a bivalent heterocyclic group which may have a substituent, two $Ar_4$ are identical with or different from each other and each represent an arylene group which may have a substituent or a bivalent heterocyclic group which may have a substituent two $Ar_5$ are identical with or different from each other and each represent a hydrogen atom, an aryl group which may have a substituent, a heterocyclic group which may have a substituent, an aralkyl group which may have a substituent, or an alkyl group which may have a substituent, $Ar_6$ represents an arylene group which may have a substituent or a bivalent heterocyclic group which may have a substituent, providing that $Ar_3$ and $Ar_6$ should not be identical, $R_1$ represents a hydrogen atom or an alky group which may have a substituent, $R_2$ and $R_3$ by the number of 2n are identical with or different from each other and each represent a hydrogen atom, an alkyl group which may have a substituent, an aryl group which may have a substituent, a heterocyclic group which may have a substituent, or an aralkyl group which may have a substituent, and n represents an integer of 0 to 2).

2. An electrophotographic photoreceptor comprising:

a conductive substrate;

a photosensitive layer formed on the conductive substrate; and a surface protection layer containing an aromatic polycarbonate formed on the photosensitive layer, wherein the aromatic polycarbonate comprises a constituent unit represented by the following general formula (1):

(1)

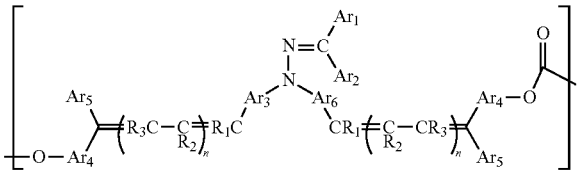

where $Ar_1$ and $Ar_2$ are identical with or different from each other and each represent an aryl group which may have a substituent or a heterocyclic group which may have a substituent, $Ar_3$ re resents an arylene group which may have a substituent or a bivalent heterocyclic group which may have a substituent two, $Ar_4$ are identical with or different from each other and each represent an arylene group which may have a substituent or a bivalent heterocyclic group which may have a substituent two $Ar_5$ are identical with or different from each other and each represent a hydrogen atom, an aryl group which may have a substituent, a heterocyclic group which may have a substituent, an aralkyl group which may have a substituent, or an alkyl group which may have a substituent, $Ar_6$ represents an arylene group which may have a substituent or a bivalent heterocyclic group which may have a substituent, providing that $Ar_3$ and $Ar_6$ should not be identical, $R_1$ represents a hydrogen atom or an alkyl group which may have a substituent, $R_2$ and $R_3$ the number of 2n are identical with or different from each other and each represent a hydrogen atom, an alkyl group which may have a substituent, an aryl group which may have a substituent, a heterocyclic group which may have a substituent, or an aralkyl group which may have a substituent, and n represents an integer of 0 to 2).

* * * * *